US012459705B2

(12) United States Patent
Noguchi

(10) Patent No.: US 12,459,705 B2
(45) Date of Patent: Nov. 4, 2025

(54) OUTER BAG WITH PRODUCT THEREIN, PRODUCTION METHOD THEREFOR, AND BAG BODY SUPPLY METHOD

(71) Applicant: SEISAN NIPPONSHA, LTD., Tokyo (JP)

(72) Inventor: Takayuki Noguchi, Tokyo (JP)

(73) Assignee: SEISAN NIPPONSHA, LTD., Tokyo (JP)

( * ) Notice: Subject to any disclaimer, the term of this patent is extended or adjusted under 35 U.S.C. 154(b) by 1417 days.

(21) Appl. No.: 17/046,031

(22) PCT Filed: Apr. 16, 2019

(86) PCT No.: PCT/JP2019/016294
§ 371 (c)(1),
(2) Date: Oct. 8, 2020

(87) PCT Pub. No.: WO2019/203223
PCT Pub. Date: Oct. 24, 2019

(65) Prior Publication Data

US 2024/0253863 A1 Aug. 1, 2024

(30) Foreign Application Priority Data

Apr. 19, 2018 (JP) ..... 2018-080858

(51) Int. Cl.
*B65D 33/25* (2006.01)
*B65B 5/10* (2006.01)
(Continued)

(52) U.S. Cl.
CPC ..... *B65D 33/2566* (2013.01); *B65B 5/10* (2013.01); *B65B 7/02* (2013.01); *B65B 9/067* (2013.01);
(Continued)

(58) Field of Classification Search
CPC ..... B65D 31/12; B65D 33/00; B65D 33/001–002; B65D 33/0425;
(Continued)

(56) References Cited

U.S. PATENT DOCUMENTS 3,406,818 A * 10/1968 Barnett ..... B65D 33/001 53/399
3,738,482 A * 6/1973 Cwikla ..... B65D 33/001 206/229
(Continued)

FOREIGN PATENT DOCUMENTS

CN 204416904 U 6/2015
DE 29803049 U1 6/1998
(Continued)

OTHER PUBLICATIONS

International Search Report dated Jul. 30, 2019 in corresponding International PCT Patent Application PCT/JP2019/016294, 6 pages.
(Continued)

*Primary Examiner* — Orlando E Aviles
*Assistant Examiner* — Brijesh V. Patel
(74) *Attorney, Agent, or Firm* — Ohlandt, Greeley and Perle, LLP.

(57) ABSTRACT

A product-containing outer bag in which a plurality of bags that are stacked continuously or intermittently in a row for parts of the bags, which are products, to overlap each other are wrapped with a cylindrical outer bag with a fastener to be integrated while a stacked state of the bags is held. The cylindrical outer bag with the fastener is made of a resin film as a base material and has a cylindrical shape having a uniform inner diameter and continuously extending along a cylinder length direction (X), at least one opening portion to be opened along the cylinder length direction (X), and the
(Continued)

fastener on an inner wall side of the base material along an edge of the opening portion, and the fastener is engaged.

6 Claims, 17 Drawing Sheets

(51) Int. Cl.

| | |
|---|---|
| ***B65B 7/02*** | (2006.01) |
| ***B65B 9/067*** | (2012.01) |
| ***B65B 25/14*** | (2006.01) |
| ***B65B 35/44*** | (2006.01) |
| ***B65B 35/50*** | (2006.01) |
| ***B65B 51/16*** | (2006.01) |
| ***B65D 33/00*** | (2006.01) |

(52) U.S. Cl.
CPC ..... *B65B 25/14* (2013.01); *B65B 35/44* (2013.01); *B65B 35/50* (2013.01); *B65B 51/16* (2013.01); *B65D 33/001* (2013.01); *B65D 33/002* (2013.01); *B65B 2220/22* (2013.01)

(58) Field of Classification Search
CPC ..... B65D 33/2508; B65D 33/2566; B65D 81/3261; B65D 29/00; A45C 3/00; A45C 13/02; A45C 13/42; B65B 5/10; B65B 7/02; B65B 9/067; B65B 9/13; B65B 25/14; B65B 35/44; B65B 35/50; B65B 51/16; B65B 2220/22; Y02W 30/80
USPC ... 383/15, 38, 40–42, 61.2–61.3, 63–64, 69, 383/97; 206/499, 526, 554
See application file for complete search history.

(56) References Cited

U.S. PATENT DOCUMENTS

| | | | | |
|---|---|---|---|---|
| 4,301,639 | A | 11/1981 | Hamilton | |
| 4,341,575 | A | 7/1982 | Herz | |
| 4,407,473 | A * | 10/1983 | Howe, Jr. | B65D 83/08 248/95 |
| 4,582,549 | A | 4/1986 | Ferrell | |
| 5,335,997 | A | 8/1994 | Kanemitsu et al. | |
| 6,138,436 | A | 10/2000 | Malin et al. | |
| 6,536,132 | B2 * | 3/2003 | Helmer | B65D 81/363 383/41 |
| 7,556,429 | B2 * | 7/2009 | Taheri | B65D 33/2566 383/38 |
| 7,850,368 | B2 * | 12/2010 | Pawloski | B65D 33/2566 24/585.12 |
| 8,449,186 | B2 * | 5/2013 | Bray | B65D 33/2508 383/69 |
| 2006/0177156 | A1 | 8/2006 | Owen et al. | |
| 2007/0294931 | A1 * | 12/2007 | Kettles | F41A 29/02 15/208 |
| 2009/0142006 | A1 * | 6/2009 | Wine | B65D 31/12 383/42 |
| 2013/0236128 | A1 * | 9/2013 | Bray | B65D 31/02 383/69 |
| 2015/0117798 | A1 * | 4/2015 | Taghvai | B65D 33/2566 383/38 |
| 2016/0101905 | A1 * | 4/2016 | Turvey | B65D 33/2533 383/64 |

FOREIGN PATENT DOCUMENTS

| | | | | |
|---|---|---|---|---|
| EP | 0443723 | | 8/1991 | |
| JP | 49-47547 | | 12/1974 | |
| JP | S4947547 | B1 | 12/1974 | |
| JP | 50-13189 | | 2/1975 | |
| JP | S5013189 | A | 2/1975 | |
| JP | 51-30081 | | 3/1976 | |
| JP | 56-500086 | | 1/1981 | |
| JP | 4-215953 | | 8/1992 | |
| JP | 5-71444 | | 10/1993 | |
| JP | 5-305956 | | 11/1993 | |
| JP | 2000-226005 | | 8/2000 | |
| JP | 2003-2302 | | 1/2003 | |
| JP | 2003-267602 | | 9/2003 | |
| JP | 2006-219198 | | 8/2006 | |
| JP | 2018-008728 | | 1/2018 | |
| WO | WO-9942368 | A1 * | 8/1999 | B65D 33/002 |

OTHER PUBLICATIONS

International Preliminary Report dated Oct. 29, 2020 in corresponding International PCT Patent Application PCT/JP2019/016294, 33 pages.
Chinese Office Action dated Apr. 19, 2022 for Chinese Appl. No. 2019-80026122.9.
Chinese Office Action dated Oct. 19, 2021 for Chinese Appl. No. 2019-80026122.9.

* cited by examiner

OUTER BAG WITH PRODUCT THEREIN, PRODUCTION METHOD THEREFOR, AND BAG BODY SUPPLY METHOD

BACKGROUND

1. Field of the Disclosure

The present disclosure relates to a cylindrical outer bag, particularly to a cylindrical outer bag that wraps a plurality of products as bundle while fixing a relative positional relationship between the products. In addition, the present disclosure relates to a product-containing outer bag in which products are wrapped with a cylindrical outer bag, and further to a wound product or a folded product of a product-containing outer bag in which the product-containing outer bag is wound by roll winding or hank winding or is zigzag-folded in a state where a cross section of the product-containing outer bag is flat. Furthermore, the present disclosure relates to a production method therefor and a method for supplying a bag by which bags that are products are taken out from a product-containing outer bag. Furthermore, the present disclosure relates to a method for using a cylindrical outer bag with a fastener and a cylindrical outer bag.

2. Discussion of the Background Art

Generally, a form where goods for sale are directly packaged is referred to as primary packaging. A form where the goods in the form of primary packaging are further packaged in a box or bag according to a determined quantity is referred to secondary packaging. The goods are delivered to consumers in the form of primary packaging or secondary packaging. Furthermore, a form where the goods in the form of secondary packaging are put in a packing box or the like according to a determined quantity for the purpose of bulk handling, warehouse storage, transport, and the like is referred to as tertiary packaging. In addition, the goods in the form of primary packaging may be packaged in the form of tertiary packaging without being subjected to secondary packaging.

For example, there is a technique where a lateral surface of the cylinder of a small wound roll (equivalent to "goods") having a cylindrical shape is wound with a film for packaging and then films for packaging located on an upper surface side and a lower surface side of the cylinder are closed and heat-welded to primarily package the small wound roll (for example, refer to FIGS. 25 to 29 in Patent Literature 1).

Incidentally, for a bag maker, goods for sale are bags used as a packaging material (for example, refer to Patent Literature 2), and thus in the present specification, when bags used as a packaging material are goods for sale, in order to distinguish the bags from goods (normal goods and hereinafter, may be also referred to as non-packaging material goods) that are not a packaging material, the bags may be referred to as "products". In addition, packaging by wrapping the bags may be referred to as outer bag.

Until bags with fasteners in which non-packaging material goods are contained are displayed at retail stores, normally, the non-packaging material goods and the bags go through a route including, first, (1) a bag making step: a bag maker produces bags and further puts the bags into an outer bag, (2) a transport step 1: the bags are delivered to a maker of the non-packaging material goods, (3) a bag supplying step: the bags are taken out from the outer bag, (4) a filling step: the bags are filled with the non-packaging material goods, and (5) a transport step 2: the non-packaging material goods with which the bags are filled are transported to the retail stores to be delivered to general consumers.

The bag making step in the related art is performed in the following procedure. Namely, the bags with fasteners that are products produced by a bag making machine are once stocked in a container such as a tray and an operation of binding a certain number of the bags with fasteners is performed by human hands. The certain number of the bound bags with fasteners which are products are fixed by binding means such as a rubber band to be subsequently put into an outer bag with a fastener and then, the fastener of the outer bag is closed. Furthermore, a plurality of the outer bags with fasteners are packed in a box. In order to prevent adhesion of dust or dirt to the box or infiltration of water into the box, the box is covered with a waterproof film and then is shipped out. These steps in their entirety require human hands.

In addition, the bag supplying step in the related art is performed in the following procedure. Namely, in order to fill the bag with the fastener with the non-packaging material goods, the maker of the non-packaging material goods peels the waterproof film off, takes out the outer bag from the box, causes the fastener of the outer bag to be disengaged, takes out the bound bags with fasteners, and removes the binding means such as a rubber band that binds the bags with fasteners, so that the bags with fasteners become individuals. These steps in their entirety also require human hands.

Furthermore, the filling step in the related art is performed in the following procedure. Namely, the individual bags with fasteners are supplied to a bag supply unit of a filling machine. This step also requires human hands. The bags with fasteners that are taken out one by one from the bag supply unit of the filling machine are opened and filled with the non-packaging material goods. This step is performed by the filling machine.

CITATION LIST

Patent Literature

Patent Literature 1: JP 2003-267602 A
Patent Literature 2: JP 2018-8728 A

Technical Problem

However, in the bag making step, the operation speed and accuracy during bag packing depends on the ability of each individual who performs the operation, and thus the speed of a packaging bag production line is required to be adjusted according to the processing capability of each individual and rest is required. As a result, the productivity is decreased and the productivity is likely to be unstable, so that the production efficiency deteriorates. In addition, the number of stocks of the bags stocked in the tray is limited due to the stock place or instability of stacking, and thus a wide space is required. Then, it takes time and labor to perform operations such as fastening the rubber band when the bound bags are put into the outer bag, opening and closing the fastener when the bound bags are put into the outer bag, box packing, and applying the waterproof film.

In addition, in the bag supplying step, the outer bags packed in the box to which the waterproof film is applied are taken out, the fasteners are disengaged, and the rubber bands and the like are removed, so that the bags with fasteners become individuals, and this step in its entirety requires human hands. Particularly, an operation of causing the bag with the fastener, which is firmly curved due to the rubber band or the like, to return to a flat shape has to be performed, and this operation in its entirety is also performed by human hands. Furthermore, the bag with the fastener in contact with the rubber band or the like may be wrinkled or may sometimes have an aperture. As described above, mistake in operation and product losses are likely to occur frequently. Furthermore, whenever the bag with the fastener is set in the filling machine and the operation is finished, it is required to return to a fastener opening step and similarly and repeatedly perform the operation for the next outer bags using human hands, which takes time and labor. Therefore, in addition to a high labor cost and a high cost, mistake in operation or the like is unavoidable. In addition, it is difficult to secure human resources due to lack of manpower, and the cost is further increased.

Furthermore, the outer bag itself is required to be produced, which requires the same labor and cost as with the bag product. In addition, various types of outer bags have to be stored together with the waterproof film, which requires warehouse management, and thus the cost is greatly increased and the labor is also required.

In addition, since the waterproof film, the shipping box, and the outer bag are discarded after the filling step, a large amount of resources are wasted.

In addition, since binding, outer bag packing, box packing, box opening, and outer bag opening are performed by human hands, dirt resulting from human may adhere, which is a problem.

SUMMARY

Therefore, an object of the present disclosure is to provide a cylindrical outer bag with a fastener, a cylindrical outer bag, a product-containing outer bag, a wound product of a product-containing outer bag, a production method therefor, and a method for supplying a bag which exhibit labor saving, resource saving, space saving, low cost, and good hygiene, specifically, which realize (1) reducing a human operation to realize the speed-up of a packaging bag production line, to stabilize the production speed, to reduce a production loss caused by mistake in human operation, and to suppress a decrease in quality of the bag, and (2) preventing a cost increase caused by making and storing the outer bag, and saving labor for the management. Furthermore, another object of the present disclosure is to provide a method for using a cylindrical outer bag with a fastener and a cylindrical outer bag.

Solution to Problem

The inventors have made extensive studies and found that when an outer bag for outer packaging is in the form of a cylindrical outer bag with a fastener or a cylindrical outer bag and a plurality of bags that are stacked continuously in a row for part of the bags, which are product, to overlap each other is wrapped with the cylindrical outer bag with the fastener for outer packaging or the cylindrical outer bag for outer packaging to be integrated while a stacked state of the bags is held, the above problems can be solved, and the inventors have completed the disclosure.

Namely, according to the disclosure, there is provided a cylindrical outer bag with a fastener for outer packaging, wherein the cylindrical outer bag with the fastener is made of a resin film as a base material and has a cylindrical shape having a uniform inner diameter and continuously extending along a cylinder length direction, at least one opening portion to be opened along the cylinder length direction, and the fastener on an inner wall side along an edge of the opening portion, the opening portion is closed when the fastener is engaged, and the cylindrical outer bag with the fastener is wound by roll winding or hank winding or is zigzag-folded in a state where a cross section of the cylindrical outer bag with the fastener is flat.

According to the disclosure, there is provided a product-containing outer bag in which a plurality of bags that are stacked continuously or intermittently in a row for parts of the bags, which are products, to overlap each other are wrapped with a cylindrical outer bag with a fastener for outer packaging to be integrated while a stacked state of the bags is held, wherein the cylindrical outer bag with the fastener is made of a resin film as a base material and has a cylindrical shape having a uniform inner diameter and continuously extending along a cylinder length direction, at least one opening portion to be opened along the cylinder length direction, and the fastener on an inner wall side of the base material along an edge of the opening portion, and the fastener is engaged.

In the product-containing outer bag according to the disclosure, it is preferable that the plurality of bags that are stacked continuously or intermittently in a row for the parts of the bags, which are products, to overlap each other are placed on the base material formed of a flat sheet-shaped resin film with the fastener for outer packaging, and the base material is folded to wrap the plurality of bags with the base material, so that the cylindrical outer bag with the fastener is obtained and the bags are integrated while the stacked state of the bags is held.

In the product-containing outer bag according to the disclosure, it is preferable that the cylindrical outer bag with the fastener includes one fastener and the fastener is located and engaged above a stacking surface of the bags. The bags can be easily wrapped in the form of palm clapping with the outer bag and the fastener is easily engaged. For this reason, production is easily performed by an apparatus having a simple structure. In addition, the fastener can be disengaged in the form of double doors.

In addition, in the product-containing outer bag according to the disclosure, it is preferable that the cylindrical outer bag with the fastener includes one fastener and the fastener is located and engaged on either a right lateral end side or a left lateral end side of the bags. Since the bags can be neatly aligned by gravity, the bags are aligned in a more orderly manner in the product-containing outer bag.

In addition, in the product-containing outer bag according to the disclosure, it is preferable that the cylindrical outer bag with the fastener includes two fasteners and the fasteners are located and engaged on a right lateral end side and a left lateral end side of the bags, respectively. The outer bag is divided into upper and lower parts, and thus the bags can be easily taken out.

According to the disclosure, there is provided a product-containing outer bag in which a plurality of bags that are stacked continuously or intermittently in a row for parts of the bags, which are products, to overlap each other are wrapped with a cylindrical outer bag for outer packaging to be integrated while a stacked state of the bags is held, wherein the cylindrical outer bag is made of a resin film as a base material and has a cylindrical shape having a uniform inner diameter and continuously extending along a cylinder length direction and at least one cut portion along the cylinder length direction, and inner walls or an inner wall and an outer wall of the base material are mutually bonded or heat-welded along an edge of the cut portion.

In the product-containing outer bag according to the disclosure, it is preferable that the plurality of bags that are stacked continuously or intermittently in a row for the parts of the bags, which are products, to overlap each other are placed on the base material formed of a flat sheet-shaped resin film for outer packaging, and the base material is folded to wrap the plurality of bags with the base material, so that the cylindrical outer bag is obtained and the bags are integrated while the stacked state of the bags is held.

According to the disclosure, there is provided a wound product or a zigzag-folded product of a product-containing outer bag, wherein the product-containing outer bag according to the disclosure is wound by roll winding or hank winding or is zigzag-folded in a state where a cross section of the product-containing outer bag is flat.

According to the disclosure, there is provided a production method for a product-containing outer bag in which a plurality of bags that are stacked continuously or intermittently in a row for parts of the bags, which are products, to overlap each other are wrapped with a cylindrical outer bag with a fastener for outer packaging to be integrated while a stacked state of the bags is held, wherein the cylindrical outer bag with the fastener is made of a resin film as a base material and has a cylindrical shape having a uniform inner diameter and continuously extending along a cylinder length direction, at least one opening portion to be opened along the cylinder length direction, and the fastener on an inner wall side of the base material along an edge of the opening portion, the opening portion has a structure where the opening portion is closed when the fastener is engaged, and the production method includes a first step of preparing the cylindrical outer bag with the fastener; a second step of causing the fastener to be disengaged and widening the cylindrical outer bag with the fastener; a third step of stacking the bags continuously or intermittently in a row along a longitudinal direction of the base material on the base material for the parts of the bags to overlap each other; and a fourth step of folding the base material to wrap the plurality of bags with the base material while moving the base material, on which the plurality of bags are placed, in the longitudinal direction of the base material and causing the fastener to be engaged, to obtain the product-containing outer bag.

In the production method for a product-containing outer bag according to the disclosure, it is preferable that the cylindrical outer bag with the fastener includes one fastener, in the second step, the base material is horizontally widened, in the third step, the base material is widened into a flat sheet shape and the bags are placed on the base material, and in the fourth step, the fastener is disposed and engaged above a stacking surface of the bags. The bags can be easily wrapped in the form of palm clapping with the outer bag and the fastener is easily engaged. For this reason, production is easily performed by an apparatus having a simple structure. In addition, the fastener can be disengaged in the form of double doors.

In addition, in the production method for a product-containing outer bag according to the disclosure, it is preferable that the cylindrical outer bag with the fastener includes one fastener, in the second step, the base material is widened, so that a cross section in the longitudinal direction of the base material has a U shape or V shape, and in the third step, the bags are put into an inside of the base material having the U shape or V shape in a state where either a right lateral end side or a left lateral end side of the bags faces downward. Since the bags can be neatly aligned by gravity, the bags are aligned in a more orderly manner in the product-containing outer bag.

In addition, in the production method for a product-containing outer bag according to the disclosure, it is preferable that the cylindrical outer bag with the fastener includes two fasteners, in the second step, one part of the base material that is divided into two parts when the fasteners are disengaged is horizontally widened and the other part of the base material is horizontally widened above the one part of the base material, in the third step, the one part of the base material is widened into a flat sheet shape and the bags are placed on the one part of the base material in a state where the fasteners located on both end sides in a width direction of the one part of the base material are located on a right lateral end side and a left lateral end side of the bags, respectively, and in the fourth step, the bags are covered with the other part of the base material and the fasteners each are engaged. The bags can be put into the outer bag by a simple operation where the outer bag is divided into upper and lower parts, the bags are disposed therebetween, and the outer bag is closed as before.

According to the disclosure, there is provided a production method for a product-containing outer bag in which a plurality of bags that are stacked continuously or intermittently in a row for parts of the bags, which are products, to overlap each other are wrapped with a cylindrical outer bag for outer packaging to be integrated while a stacked state of the bags is held, the method including: a step A of preparing a strip-shaped resin film with a uniform width as a base material; a step B of widening the base material; a step C of stacking the plurality of bags continuously or intermittently in a row along a longitudinal direction of the base material on the base material for the parts of the bags to overlap each other; and a step D of folding the base material to wrap the plurality of bags with the base material while moving the base material, on which the plurality of bags are placed, in the longitudinal direction of the base material, and mutually bonding or heat-welding inner walls or an inner wall and an outer wall of the base material along both end edges in a width direction of the base material to form the base material into a cylindrical shape, to obtain the product-containing outer bag.

In the production method for a product-containing outer bag according to the disclosure, it is preferable that in the step A, one base material is prepared, in the step B, the base material is horizontally widened, in the step C, the base material is widened into a flat sheet shape and the bags are placed on the base material, and in the step D, both the end edges in the width direction of the base material are disposed above a stacking surface of the bags, and both the end edges in the width direction of the base material are mutually bonded or heat-welded. The bags can be easily wrapped in the form of palm clapping with the outer bag and bonding or heat welding is easily performed. For this reason, production is easily performed by an apparatus having a simple structure.

In addition, in the production method for a product-containing outer bag according to the disclosure, it is preferable that in the step A, one base material is prepared, in the step B, the base material is widened, so that a cross section in the longitudinal direction of the base material has a U shape or V shape, and in the step C, the bags are put into an inside of the base material having the U shape or V shape in a state where either a right lateral end side or a left lateral end side of the bags faces downward. Also in this form, since the bags can be neatly aligned by gravity, the bags are aligned in a more orderly manner in the product-containing outer bag.

In addition, in the production method for a product-containing outer bag according to the disclosure, it is preferable that in the step A, two base materials are prepared, in the step B, one base material is horizontally widened and the other base material is horizontally widened above the one base material, in the step C, the one base material is widened into a flat sheet shape and the bags are placed on the one base material in a state where both ends in a width direction of the one base material are located on a right lateral end side and a left lateral end side of the bags, respectively, and in the step D, the bags are covered with the other base material and the one base material and the other base material are mutually bonded or heat-welded. The bags can be put into the outer bag by a simple operation where the two base materials are disposed on upper and lower sides, the bags are disposed therebetween, and the outer bag is closed.

According to the disclosure, there is provided a production method for a wound product or a zigzag-folded product of a product-containing outer bag, the method including: a fifth step of winding the product-containing outer bag according to the disclosure by roll winding or hank winding or zigzag-folding the product-containing outer bag in a state where a cross section of the product-containing outer bag is flat.

According to the disclosure, there is provided a method for supplying a bag, the method including: a sixth step of opening an engaged portion, a joint portion, or a location other than the engaged portion or the joint portion in an outer bag while pulling out the product-containing outer bag according to the disclosure or the outer bag of the wound product or the zigzag-folded product of a product-containing outer bag according to the disclosure; and a seventh step of sequentially supplying the bags in the opened outer bag to a filling machine.

According to the disclosure, there is provided a method for using a cylindrical outer bag with a fastener for outer packaging that is a product-containing outer bag in which a plurality of products that are stacked continuously or intermittently in a row for parts of the products to overlap each other are wrapped with the cylindrical outer bag with the fastener for outer packaging to be integrated while a stacked state of the products is held, wherein the cylindrical outer bag with the fastener is made of a resin film as a base material and has a cylindrical shape having a uniform inner diameter and continuously extending along a cylinder length direction, at least one opening portion to be opened along the cylinder length direction, and the fastener on an inner wall side along an edge of the opening portion, the opening portion is closed when the fastener is engaged, and the cylindrical outer bag with the fastener is wound by roll winding or hank winding or is zigzag-folded in a state where a cross section of the cylindrical outer bag with the fastener is flat. Here, the product includes a bag.

In addition, according to the disclosure, there is provided a method for using a cylindrical outer bag for outer packaging that is a product-containing outer bag in which a plurality of products that are stacked continuously or intermittently in a row for parts of the products to overlap each other are wrapped with a cylindrical outer bag for outer packaging to be integrated while a stacked state of the products is held, wherein the cylindrical outer bag is made of a resin film as a base material and has a cylindrical shape having a uniform inner diameter and continuously extending along a cylinder length direction and at least one cut portion along the cylinder length direction, and inner walls or an inner wall and an outer wall of the base material are mutually bonded or heat-welded along an edge of the cut portion. Here, the product includes a bag.

Advantageous Effects of the Disclosure

According to the present disclosure, it is possible to provide the cylindrical outer bag with the fastener, the cylindrical outer bag, the product-containing outer bag, the wound product of a product-containing outer bag, the production method therefor, and the method for supplying a bag which exhibit labor saving, resource saving, space saving, low cost, and good hygiene, specifically, which realize (1) reducing a human operation to realize the speed-up of a packaging bag production line, to stabilize the production speed, to reduce a production loss caused by mistake in human operation, and to suppress a decrease in quality of the bag, and (2) preventing a cost increase caused by making and storing the outer bag, and saving labor for the management. Furthermore, the present disclosure can provide a method for using the cylindrical outer bag with the fastener and the cylindrical outer bag.

Furthermore, when a bag making machine and the filling machine are integrated in an inline manner, the production efficiency is increased, but a person who performs filling is also required to perform maintenance on the bag making machine. However, according to the disclosure, even if the equipment is not installed in an inline manner, since the product-containing outer bag can substantially reproduce the bag making machine, the bags can be supplied to the filling machine at high speed. Therefore, from the perspective of the person who performs filling, the maintenance of the bag making machine is not required and the inline production can be substantially reproduced. Furthermore, from the perspective of a person who makes the bags, an operation of binding bags may not be required and an inspection step associated with the operation may not be also required.

Furthermore, in the wound product of a product-containing outer bag, since air in the outer bag is removed by winding, a contact state between an inner wall of the outer bag and the bag and a contact state between the bags are not destroyed even during transport, and thus when the outer bag is unsealed and the bags are taken out, the packed state of the bags can be reproduced as it is.

DETAILED DESCRIPTION OF THE PREFERRED EMBODIMENT

Figure 1:
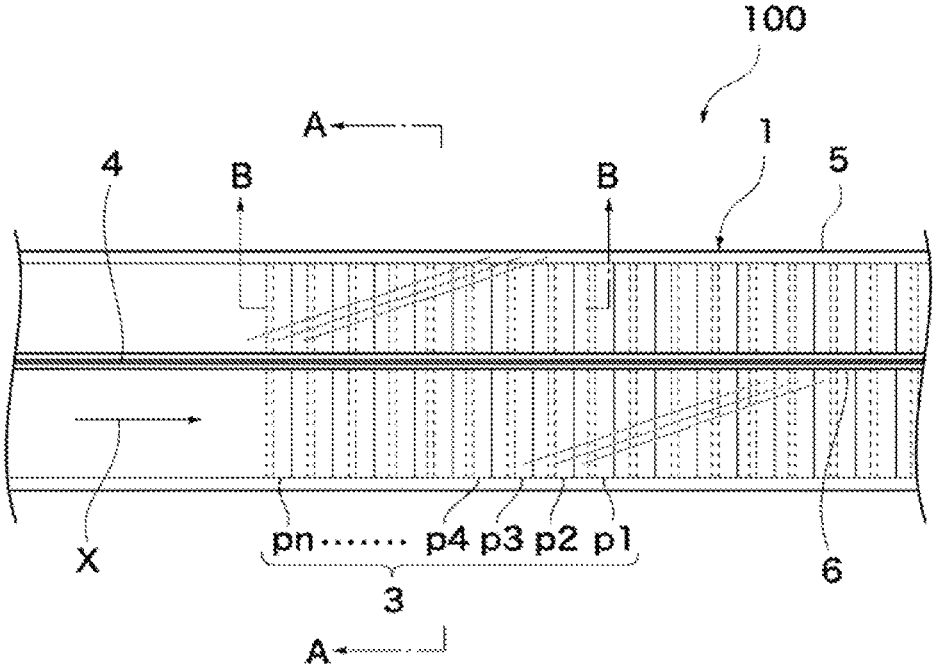
FIG. 1 is a front schematic view illustrating a first example of a product-containing outer bag according to the present embodiment.

Next, the disclosure will be described in detail with reference to embodiments; however, the disclosure should not be interpreted as being limited to the descriptions. As long as the effects of the disclosure are exhibited, the embodiments may be modified in various forms.

(Cylindrical Outer Bag with a Fastener)

A cylindrical outer bag with a fastener according to the present embodiment will be described with reference to FIGS. 1 to 5. A cylindrical outer bag 1 with a fastener according to the present embodiment is a cylindrical outer bag with a fastener for outer packaging, wherein the cylindrical outer bag 1 with the fastener is made of a resin film as a base material 5 and has a cylindrical shape having a uniform inner diameter and continuously extending along a cylinder length direction X, at least one opening portion 6 to be opened along the cylinder length direction X, and the fastener 4 on an inner wall side along an edge 6*a* of the opening portion 6, the opening portion 6 is closed when the fastener 4 is engaged, and the cylindrical outer bag 1 with the fastener is wound by roll winding or hank winding or is zigzag-folded in a state where the cross section of the cylindrical outer bag 1 with the fastener is flat.

The outer packaging refers to a form (including both secondary packaging and tertiary packaging) where a plurality of goods for sale (including not only goods but also goods that are individually and primarily packaged) are packaged in a unit of bundle. In addition, the outer bag refers particularly to a bag for outer packaging. Therefore, the cylindrical outer bag in the embodiment refers to a bag that has a cylindrical shape and is used for outer packaging.

The material of the resin film as the base material 5 is, for example, polyethylene resin or polypropylene resin and any one from <1> to <29> provided below as examples is adopted; however, in the present embodiment, the material is not particularly limited.

<1> High density polyethylene (HDPE)
<2> Medium density polyethylene (MDPE)
<3> Low density polyethylene (LDPE)
<4> Polypropylene (PP)
<5> Polyvinylidene chloride (PVDC)
<6> Polyvinyl chloride (PVC)
<7> Polystyrene (PS)
<8> Polyvinyl acetate (PVAc)
<9> Polytetrafluoroethylene (PTFE)
<10> ABS resin (Acrylonitrile butadiene styrene resin)
<11> AS resin (SAN)
<12> Acrylic resin (PMMA)
<13> Polyamide (PA)/Product name: Nylon
<14> Polyacetal (POM)
<15> Polycarbonate (PC)
<16> Modified polyphenylene ether (m-PPE, modified PPE, PPO)
<17> Polybutylene terephthalate (PBT)
<18> Polyethylene terephthalate (PET)
<19> Cyclic polyolefin (COP)
<20> Polyphenylene sulfide (PPS)
<21> Polysulfone (PSF)
<22> Polyether sulfone (PES)
<23> Amorphous polyarylate (PAR)
<24> Liquid crystal polymer (LCP)
<25> Polyether ether ketone (PEEK)
<26> Thermoplastic polyimide (PI)
<27> Polyamide imide (PAI)
<28> Thermoplastic polyurethane (TPU)
<29> Fluororesin (PTFE)

In addition, it is desirable that the thickness of the base material 5 formed of a single-layer film is approximately 0.2 to 1.5 mm, and it is desirable that the thickness of the base material 5 formed of a multi-layer film is approximately 0.4 to 2.0 mm. In addition, the cylindrical outer bag 1 with the fastener has a cylindrical shape having a uniform inner diameter and continuously extending in the cylinder length direction X when the inside of the cylinder is widened. The inner diameter (diameter) is, for example, 1.5 to 65 cm, but is not limited to this range. In addition, an upper end portion and a lower end portion of the cylindrical shape may be opened, or may be closed by bonding, heat welding, or binding.

Figure 2:
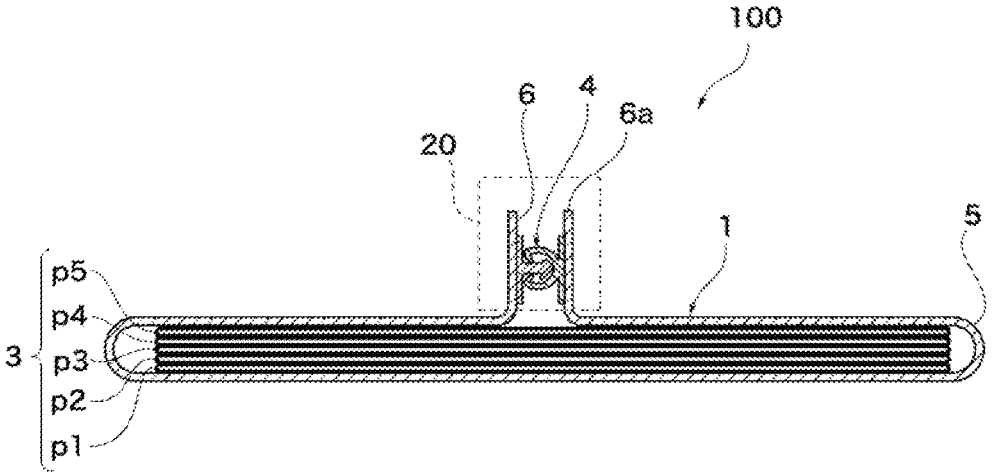
FIG. 2 is a cross-sectional view along line A-A in FIG. 1.

As illustrated in FIGS. 1 and 2, the opening portion 6 is provided in the base material 5 along the cylinder length direction X. In the present embodiment, the cylindrical outer bag 1 with the fastener has at least one opening portion 6. In a case where one opening portion 6 is provided, when the opening portion is widened, the base material becomes one belt-shaped film. The cylindrical outer bag 1 with the fastener illustrated in FIGS. 1 to 7 has one opening portion 6. In a case where two opening portions 6 are provided, when the opening portions are widened, the base material becomes two belt-shaped films. Here, it is preferable that the opening portions are provided for the two belt-shaped films to have the same width. Incidentally, it is preferable that the opening portion 6 is formed over both ends of the cylindrical shape.

Figure 4:
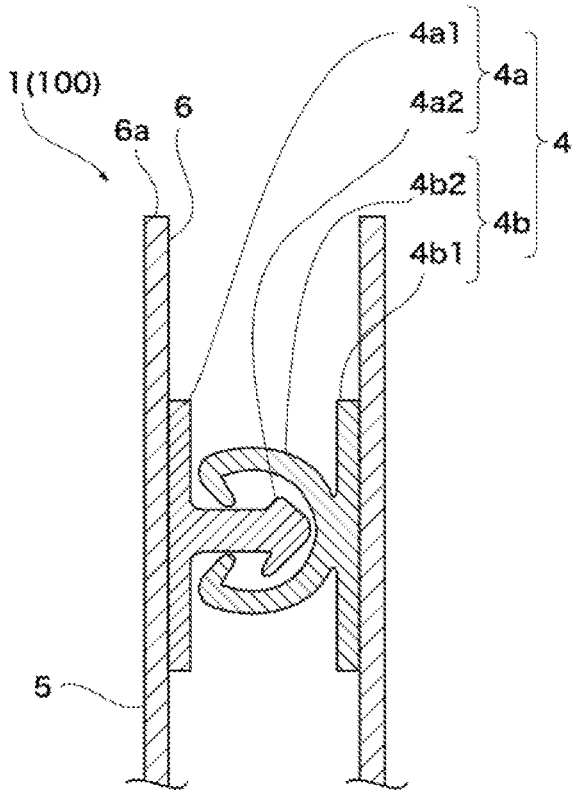
FIG. 4 is a partial enlarged view illustrating a first example of a fastener in a region 20 of FIG. 2.
Figure 5:
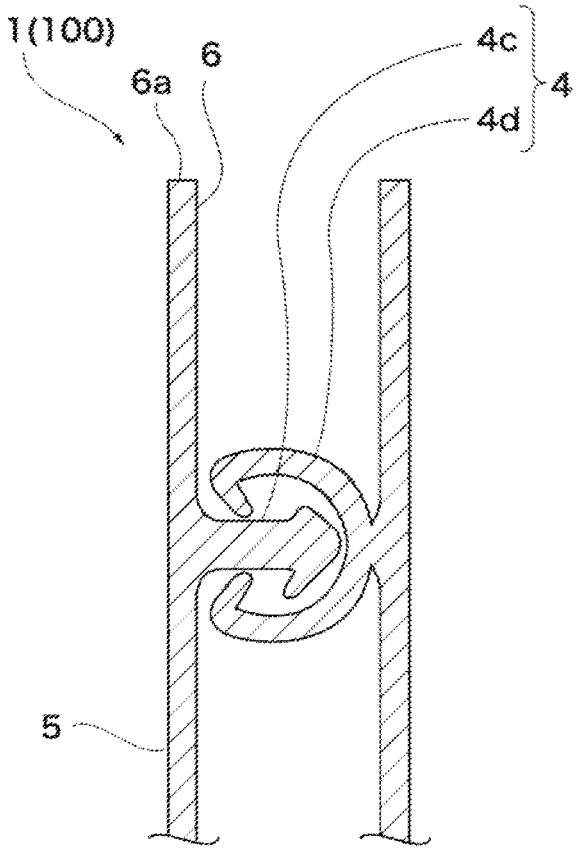
FIG. 5 is a partial enlarged view illustrating a second example of the fastener in the region 20 of FIG. 2.

As illustrated in FIGS. 1 and 2, the fastener 4 is provided on the inner wall side along the edge 6*a* of the opening portion 6. The fastener 4 may have any structure as long as the structure is an openable and closable structure where the fastener 4 is closed when engaged and is opened when disengaged. For example, as illustrated in FIG. 4, it is preferable that the fastener 4 includes a female member 4*b* having a female base portion 4*b*1 and a female portion 4*b*2 that have a strip shape and extend in the cylinder length direction X, and a male member 4*a* having a male base portion 4*a*1 and a male portion 4*a*2 that have a strip shape and extend in the cylinder length direction X, and the fastener 4 has a chuck structure where the fastener 4 is closed when the male portion 4*a*2 is engaged with the female portion 4*b*2. The male base portion 4*al* and the female base portion 4*b*1 of the fastener 4 illustrated in FIG. 4 are bonded to an inner wall surface of the base material 5. In addition, as illustrated in FIG. 5, the fastener 4 may have a female portion 4*d* extending in the cylinder length direction X and a male portion 4*c* extending in the cylinder length direction X, and may have a chuck structure where the fastener 4 is closed when the male portion 4*c* is engaged with the female portion 4*d*. The male portion 4*c* and the female portion 4*d* of the fastener 4 illustrated in FIG. 5 is formed integrally with the base material 5. In the present embodiment, the fastener 4 is not limited to having the chuck structure illustrated in FIGS. 4 and 5, and may have, for example, a structure where female portions engage with each other.

The cylindrical outer bag 1 with the fastener is wound by roll winding or hank winding or is zigzag-folded in a state where the cross section is flat. The state where the cross section is flat refers to a state where inner wall surfaces of the cylindrical shape face each other and are in contact with each other. The roll winding includes bobbin winding, core winding, and coreless winding. In the form of roll winding and hank winding, since the cross section of the cylindrical outer bag 1 with the fastener is in a flat state, a space in the cylinder is deaerated and thus the cylindrical outer bag 1 with the fastener has a strip shape, and it is preferable that the cylindrical outer bag 1 with the fastener is wound such that flat outer wall surfaces are in contact with each other. The volume of the cylindrical outer bag with the fastener which is wound can be reduced. In addition, also in the form of zigzag-folding, namely, in the form of folding in a zigzag manner, the cross section of the cylindrical outer bag 1 with the fastener is in a flat state, the space in the cylinder is deaerated and thus the cylindrical outer bag 1 with the fastener has a strip shape, and it is preferable that the cylindrical outer bag 1 with the fastener is folded such that the flat outer wall surfaces are in contact with each other. The volume of the cylindrical outer bag with the fastener which is zigzag-folded can be reduced.

(Product-Containing Outer Bag: First Example)

Next, a product-containing outer bag 100 (first example) according to the present embodiment will be described with reference to FIGS. 1 to 3 and FIGS. 6 and 7. The product-containing outer bag 100 according to the present embodiment is a product-containing outer bag in which a plurality of bags 3 that are stacked continuously or intermittently in a row for parts of the bags (p1, p2, p3, p4, . . . , pn), which are products, to overlap each other are wrapped with the cylindrical outer bag 1 with the fastener for outer packaging to be integrated while a stacked state of the bags is held, wherein the cylindrical outer bag 1 with the fastener is made of a resin film as the base material 5 and has a cylindrical shape having a uniform inner diameter and continuously extending along the cylinder length direction X, at least one opening portion 6 to be opened along the cylinder length direction X, and the fastener 4 on the inner wall side of the base material 5 along the edge 6*a* of the opening portion 6, and the fastener 4 is engaged.

In the product-containing outer bag 100 (first example) according to the present embodiment, it is preferable that, in the product-containing outer bag 100, the plurality of bags 3 that are stacked continuously or intermittently in a row for the parts of the bags (p1, p2, p3, p4, . . . , pn), which are products, to overlap each other are placed on the base material 5 formed of a flat sheet-shaped resin film with the fastener for outer packaging, and the base material 5 is folded to wrap the plurality of bags 3 with the base material 5, so that the cylindrical outer bag 1 with the fastener is obtained and the bags are integrated while the stacked state of the bags 3 is held.

Figure 3:
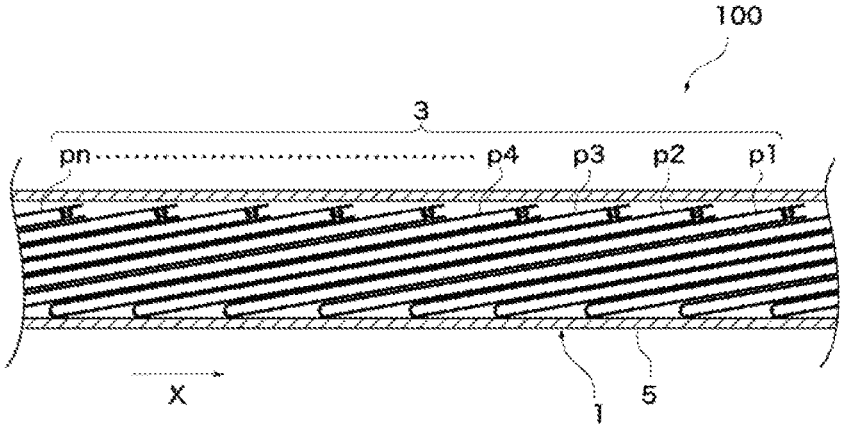
FIG. 3 is a cross-sectional view along line B-B in FIG. 1.
Figure 6:
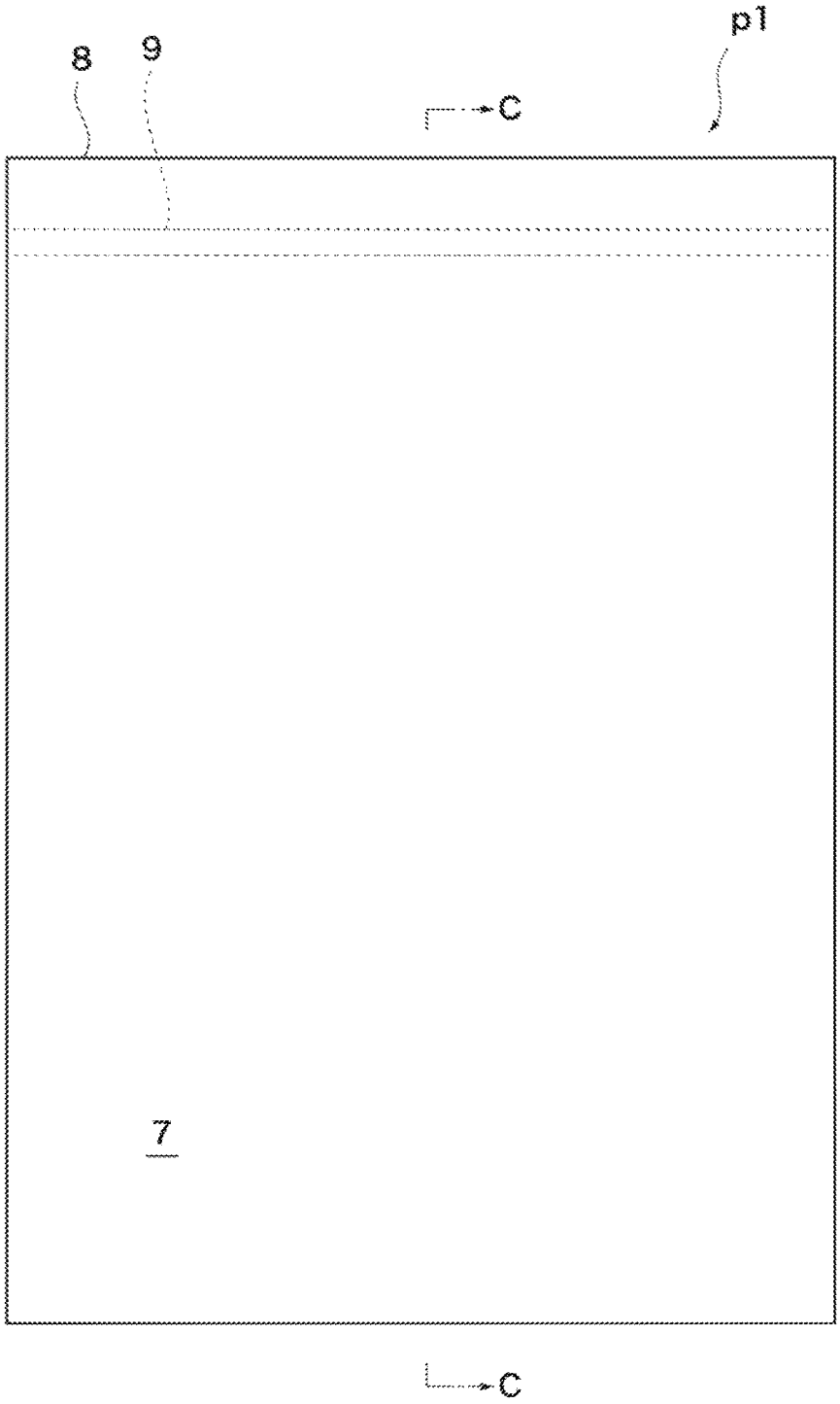
FIG. 6 is a front schematic view illustrating one form of a bag to be accommodated in the product-containing outer bag according to the present embodiment.
Figure 7:
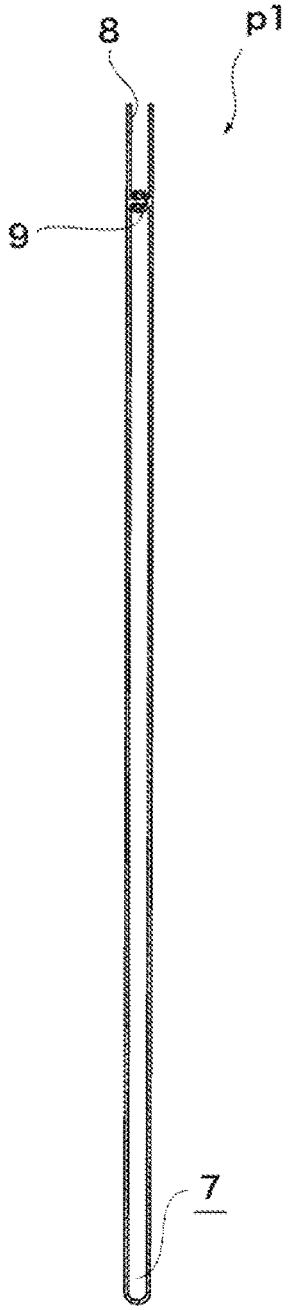
FIG. 7 is a cross-sectional view along line C-C in FIG. 6.

In the product-containing outer bag 100 according to the present embodiment, the plurality of bags that are products are accommodated in the cylinder of the cylindrical outer bag 1 with the fastener for outer packaging. As illustrated in FIGS. 6 and 7, a bag p1 that is a product is a plastic bag made of resin and having an opening portion 8 and an accommodating portion 7, and a chuck 9 is provided along an end of the opening portion 8. The chuck 9 has a fastener structure, for example, the same structure as that of the fastener 4 of the cylindrical outer bag 1 with the fastener, and is openable and closable. The bags p2, p3, p4, . . . , pn that are products are bags have the same structure as that of the bag p1. Since the bags (p1, p2, p3, p4, . . . , pn) that are products have a flat structure, as illustrated in FIG. 3, the bags can be the plurality of bags 3 that are stacked in a row for parts thereof to overlap each other. Here, in the cylindrical outer bag 1 with the fastener, the plurality of bags 3 may be arranged to be continuously connected along the cylinder length direction X, or may be arranged intermittently, namely, may be arranged to be interrupted at locations on the way. It is preferable that the intermittent arrangement is, for example, an arrangement where a predetermined number of bags are stacked in a row for parts thereof to overlap each other and then a gap is provided, the same number of the bags are successively stacked in a row for parts thereof to overlap each other and then a gap is provided again, and this pattern is repeated. The number of the bags is easily confirmed. In the present embodiment, the plurality of bags 3 that are stacked in a row for parts thereof to overlap each other are integrated in the form of the product-containing outer bag 100, and thus may be simply referred to as "the plurality of bags 3" or "the bags 3".

As illustrated in FIG. 2, the product-containing outer bag 100 wraps the plurality of bags 3 with the cylindrical outer bag 1 with the fastener. Here, it is preferable that when the cylindrical outer bag 1 with the fastener accommodates the plurality of bags 3, the width of the cylindrical outer bag 1 with the fastener is slightly larger than the width of the plurality of bags 3, for example, it is preferable that the width is larger by 1 to 10 mm, and in this case, it is preferable that the cylindrical outer bag 1 with the fastener has a holding force to such an extent that the arrangement of the plurality of bags 3 does not collapse when the fastener 4 is closed. The bags 3 can be more integrated while a stacked state thereof is held, and since extra air does not infiltrate into the cylinder, an increase in volume can be suppressed. When the fastener 4 is engaged, the cylindrical outer bag 1 with the fastener integrates the bags 3 in a state where the cylindrical outer bag 1 with the fastener contains the bags 3.

Since the product-containing outer bag 100 can not only handle the plurality of bags 3 as bulk during transport, during storage, or during both transport and storage, but also fix a state of arrangement of bags to be sequentially produced from a bag making machine, even if the bag making machine and a filling machine are installed in different places, the inline production can be substantially reproduced.

It is preferable that, as illustrated in FIG. 2, the cylindrical outer bag 1 with the fastener includes one fastener 4 and the fastener 4 is located and engaged above a stacking surface of the bags 3. The bags 3 can be easily wrapped in the form of palm clapping with the outer bag and the fastener 4 is easily engaged. For this reason, production is easily performed by an apparatus having a simple structure. In addition, the fastener 4 can be disengaged in the form of double doors. It is more preferable that, as illustrated in FIG. 2, the fastener 4 is located in a central portion of the stacking surface of the bags 3. An engagement operation and a disengagement operation can be more stably performed, and roll winding, hank winding, or zigzag folding can be more stably performed.

(Product-Containing Outer Bag: Second Example)

Next, a product-containing outer bag 200 (second example) according to the present embodiment will be described with reference to FIGS. 8 and 9. In the product-containing outer bag 200 according to the present embodiment, it is preferable that a cylindrical outer bag 11 with a fastener includes one fastener 14 and the fastener 14 is located and engaged on either a right lateral end side or a left lateral end side of bags 13. As illustrated in FIG. 9, the product-containing outer bag 200 is the same as the product-containing outer bag 100 except that the position of the fastener 14 is different. Namely, in the product-containing outer bag 200, when a plurality of the bags 13 are wrapped with the cylindrical outer bag 11 with the fastener and the fastener 14 is engaged, the cylindrical outer bag 11 with the fastener integrates the bags 13 in a state where the cylindrical outer bag 11 with the fastener contains the bags 13. In the product-containing outer bag 200, the adhesion of a base material 15 to the bag 13 is further enhanced. Also in the product-containing outer bag 200, similar to the case of the product-containing outer bag 100, it is preferable that when the cylindrical outer bag 11 with the fastener accommodates the plurality of bags 13, the width of the cylindrical outer bag 11 with the fastener is slightly larger than the width of the plurality of bags 13, for example, it is preferable that the width is larger by 1 to 10 mm. In FIG. 9, the fastener 14 is located on a left lateral end side of the cylindrical outer bag 11 with the fastener, and thus an opening portion 16 is provided in a left lateral end portion and a left edge becomes an edge 16*a* of the opening portion 16. FIG. 9 illustrates a form where the fastener 14 is located on the left lateral end side of the cylindrical outer bag 11 with the fastener; however, the fastener 14 may be located on a right lateral end side. The product-containing outer bag 200 according to the present embodiment has a form where bags can be neatly aligned by gravity when bags (p1, p2, p3, p4, . . . , pn) are put into the cylindrical outer bag 11 with the fastener, and after the bags 13 are integrated by the cylindrical outer bag 11 with the fastener, the bags 13 are aligned in a more orderly manner in the product-containing outer bag 200.

(Product-Containing Outer Bag: Third Example)

Figure 10:
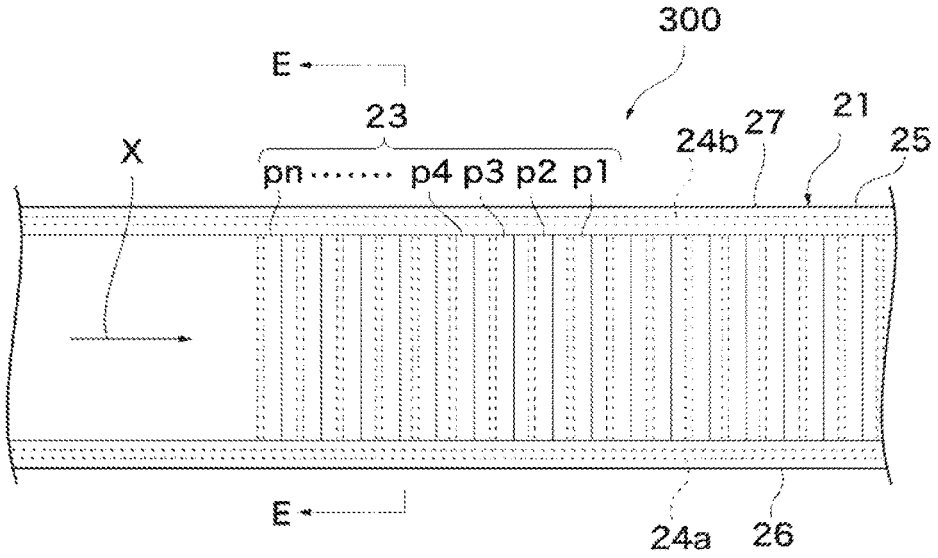
FIG. 10 is a front schematic view illustrating a third example of the product-containing outer bag according to the present embodiment.
Figure 11:
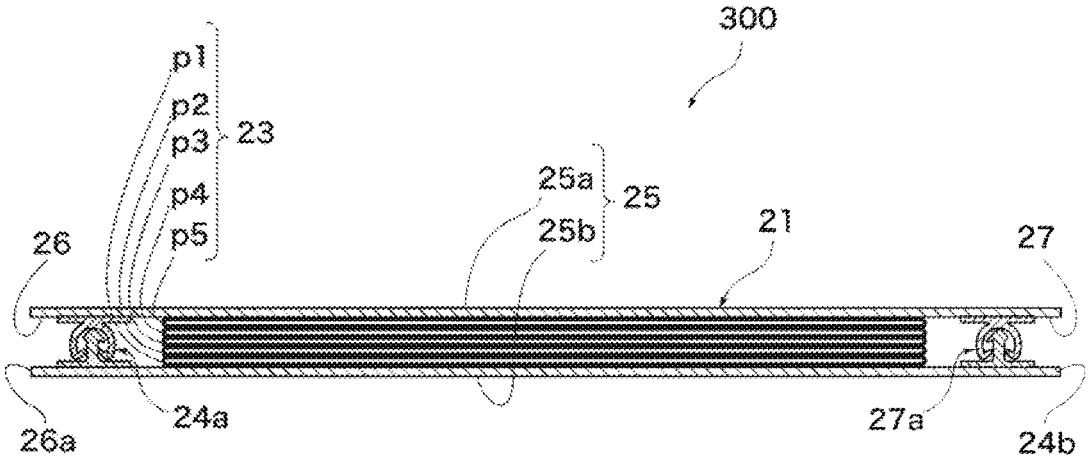
FIG. 11 is a cross-sectional view along line E-E in FIG. 10.

Next, a product-containing outer bag 300 (third example) according to the present embodiment will be described with reference to FIGS. 10 and 11. In the product-containing outer bag 300 according to the present embodiment, it is preferable that a cylindrical outer bag 21 with a fastener includes two fasteners 24*a* and 24*b* and the fasteners 24*a* and 24*b* are located and engaged on a left lateral end side and a right lateral end side of bags 23, respectively. As illustrated in FIG. 11, the product-containing outer bag 300 is the same as the product-containing outer bag 100 except that the two fasteners 24*a* and 24*b* are provided and the positions of the fasteners 24*a* and 24*b* are different. Namely, in the product-containing outer bag 300, when a plurality of the bags 23 are wrapped with the cylindrical outer bag 21 with the fastener and the fasteners 24*a* and 24*b* each are engaged, the cylindrical outer bag 21 with the fastener integrates the bags 23 in a state where the cylindrical outer bag 21 with the fastener contains the bags 23. In the product-containing outer bag 300, similar to the product-containing outer bag 200, the adhesion of a base material 25 to the bag 23 is further enhanced. Also in the product-containing outer bag 300, similar to the case of the product-containing outer bag 100, it is preferable that when the cylindrical outer bag 21 with the fastener accommodates the plurality of bags 23, the width of the cylindrical outer bag 21 with the fastener is slightly larger than the width of the plurality of bags 23, for example, it is preferable that the width is larger by 1 to 10 mm. In FIG. 11, the fastener 24*a* is located on a left lateral end side of the cylindrical outer bag 21 with the fastener, and thus an opening portion 26 is provided in a left lateral end portion and a left edge becomes an edge 26*a* of the opening portion 26. In addition, the fastener 24*b* is located on a right lateral end side of the cylindrical outer bag 21 with the fastener, and thus an opening portion 27 is provided in a right lateral end portion and a right edge becomes an edge 27*a* of the opening portion 27. When the fastener 24*a* and the fastener 24*b* each are disengaged, the base material 25 of the cylindrical outer bag 21 with the fastener is divided into a base material 25*a* (also referred to as the other part 25*a* of the base material) and a base material 25*b* (also referred to as one part 25*b* of the base material) for the product-containing outer bag 300 according to the present embodiment to be opened, and thus the bags 23 can be easily taken out.

(Product-Containing Outer Bag: Fourth Example)

Figure 12:
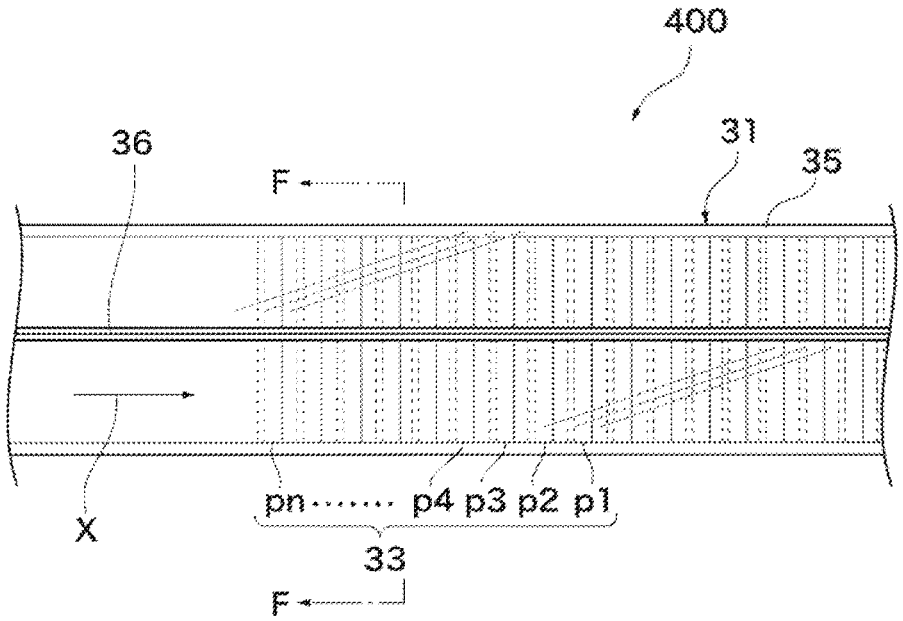
FIG. 12 is a front schematic view illustrating a fourth example of the product-containing outer bag according to the present embodiment, and is a view illustrating a form where the outer bag is closed by bonding or heat welding.

Next, a product-containing outer bag 400 (fourth example) according to the present embodiment will be described with reference to FIGS. 12 and 13. In the product-containing outer bag 400 according to the present embodiment, the outer bag is closed by bonding or heat welding. The product-containing outer bag 400 according to the present embodiment is a product-containing outer bag in which a plurality of bags 33 that are stacked continuously or intermittently in a row for parts of the bags (p1, p2, p3, p4, . . . , pn), which are products, to overlap each other are wrapped with a cylindrical outer bag 31 for outer packaging to be integrated while a stacked state of the bags is held, wherein the cylindrical outer bag 31 is made of a resin film as a base material 35 and has a cylindrical shape having a uniform inner diameter and continuously extending along a cylinder length direction X and at least one cut portion 36 along the cylinder length direction X, and inner walls or an inner wall and an outer wall of the base material 35 are mutually bonded or heat-welded along an edge 36*a* of the cut portion 36.

In the product-containing outer bag 400 according to the present embodiment, the plurality of bags which are products are accommodated in the cylinder of the cylindrical outer bag 31 for outer packaging. The bags (p1, p2, p3, p4, . . . , pn) which are products are the same as the bag (bag p1 illustrated in FIGS. 6 and 7) described in the product-containing outer bag 100. In addition, a state of the plurality of bags 33 is the same as the state of the plurality of bags 3 in the product-containing outer bag 100.

Figure 13:
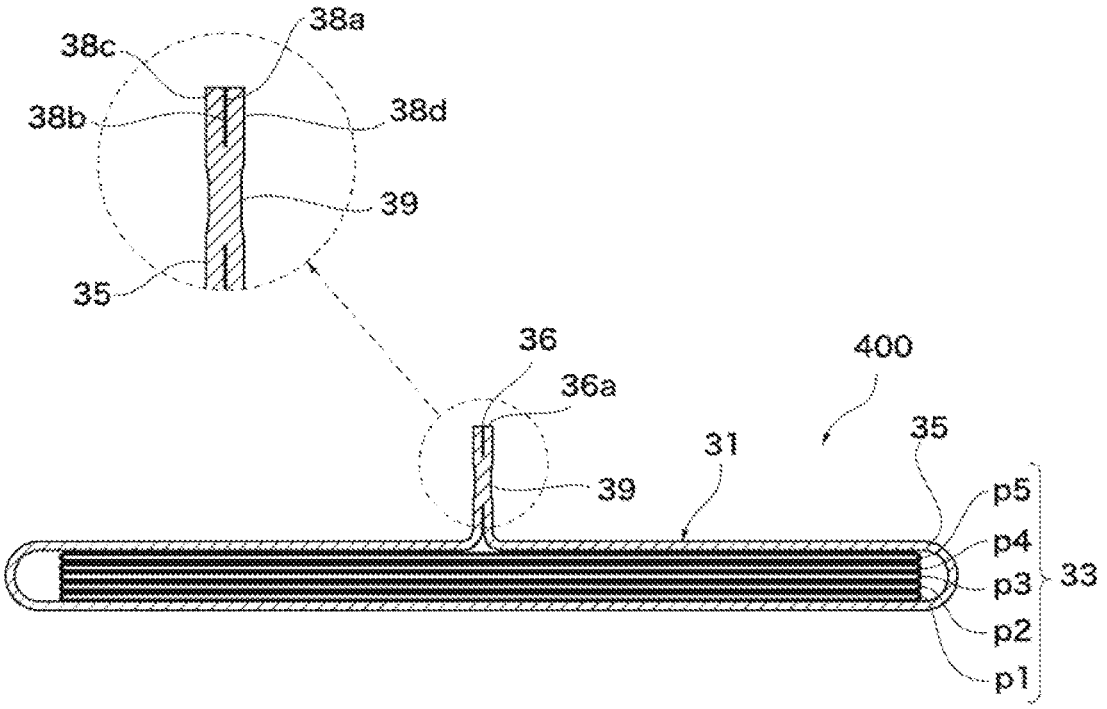
FIG. 13 is a cross-sectional view along line F-F in FIG. 12.

As illustrated in FIG. 13, the product-containing outer bag 400 wraps the plurality of bags 33 with the cylindrical outer bag 31. In this case, the cylindrical outer bag 31 has a joint portion 39 in which inner walls 38*a* and 38*b* of the base material 35 are bonded or heat-welded. Here, it is preferable that when the cylindrical outer bag 31 accommodates the plurality of bags 33, the width of the cylindrical outer bag 31 is slightly larger than the width of the plurality of bags 33, for example, it is preferable that the width is larger by 1 to 10 mm. It is preferable that the fastening of the plurality of bags 33 by the cylindrical outer bag 31 has a holding force to such an extent that the arrangement of the plurality of bags 33 does not collapse. The bags 33 can be more integrated while a stacked state thereof is held, and since extra air does not infiltrate into the cylinder, an increase in volume can be suppressed. When the inner walls 38*a* and 38*b* of the base material 35 are bonded or heat-welded, the cylindrical outer bag 31 integrates the bags 33 in a state where the cylindrical outer bag 31 contains the bags 33. Alternatively, when the inner wall 38*a* of the base material 35 and an outer wall 38*d* of the base material 35 are bonded or heat-welded, the cylindrical outer bag 31 may integrate the bags 33 in a state where the cylindrical outer bag 31 contains the bags 33 (not illustrated). In the present embodiment, the bonding is joining by adhesive agents including, for example, a glue and tape, and the heat welding is joining by heat sealing, ultrasound sealing, high frequency sealing, spot sealing, an impulse sealer, or laser. The cut portion 36 represents a discontinuous portion that is present at the location of the joint portion 39 in the cylindrical outer bag 31, which is closed, in a circumferential direction of a trunk of the base material 35. Regarding the cut portion 36, a portion where the films facing each other closer to outside than the joint portion 39 of the films are not bonded may be provided or may not be provided. In the cylindrical outer bag 31, not only one cut portion 36 may be provided as in the form illustrated in FIG. 13, but also two or more cut portions may be provided. For example, a form where the cut portions are provided at locations corresponding to the positions of the fasteners 24*a* and 24*b* in FIG. 11, respectively, and a total of two cut portions are provided may be adopted (not illustrated).

Similar to the product-containing outer bags 100, 200, and 300, since also the product-containing outer bag 400 can not only handle the plurality of bags 33 as bulk during transport, during storage, or during both transport and storage, but also fix a state of arrangement of bags to be sequentially produced from the bag making machine, even if the bag making machine and the filling machine are installed in different places, the inline production can be substantially reproduced.

In the cylindrical outer bag 31, when the base material 35 is cut along the cylinder length direction X, the bags 33 can be sequentially taken out. It is preferable that the cutting location is the cut portion 36. In order to unseal the cylindrical outer bag 31, in addition to a method of peeling the joint portion 39 to unseal the cylindrical outer bag 31 as illustrated in FIG. 13, for example, a method where a weak portion is provided in the film of the cylindrical outer bag 31 by scratching or half cutting and the cylindrical outer bag 31 is unsealed from the weak portion may be used.

(Wound Product of Product-Containing Outer Bag)

Figure 14:
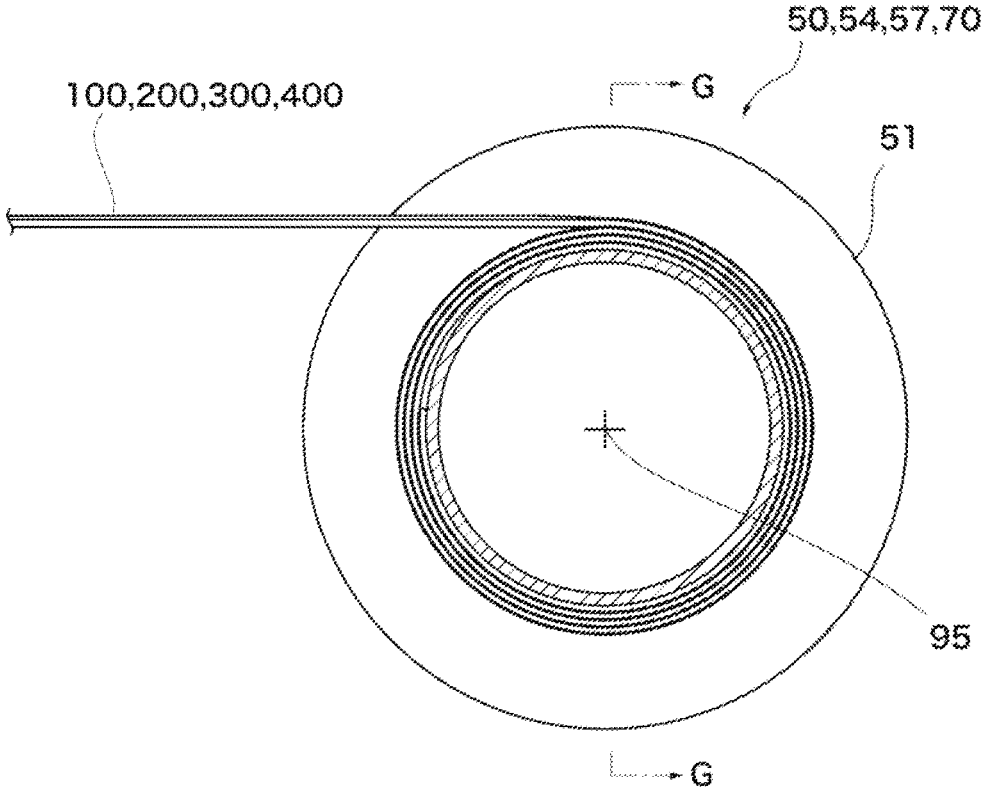
FIG. 14 is a schematic view illustrating a first example of a wound product of a product-containing outer bag according to the present embodiment.
Figure 15:
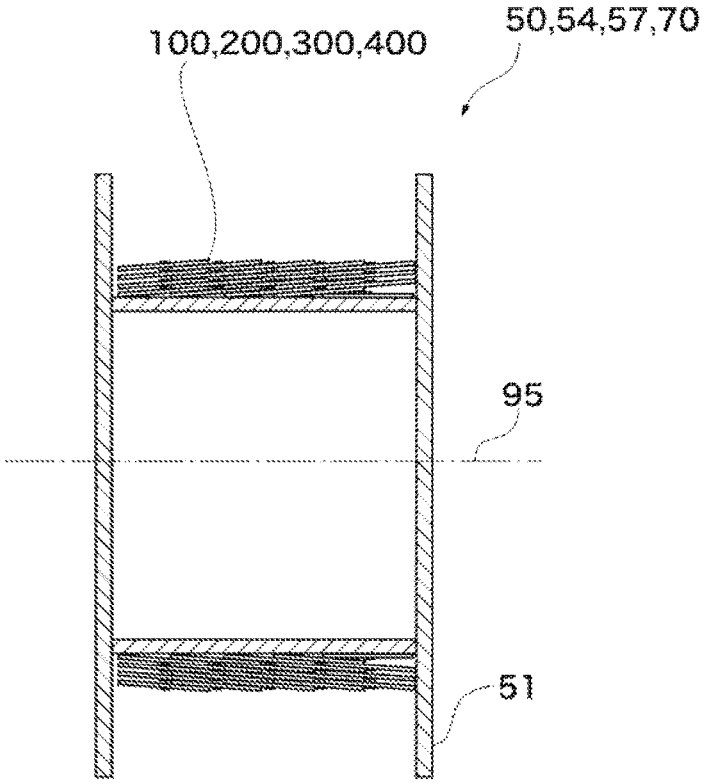
FIG. 15 is a cross-sectional view along line G-G in FIG. 14.

FIGS. 14 and 15 illustrate a wound product 50 of a product-containing outer bag according to the present embodiment, wherein the product-containing outer bag 100, 200, 300, or 400 according to the present embodiment is wound by roll winding in a state where the cross section is flat. As one form of roll winding, FIG. 14 illustrates a form where the product-containing outer bag 100, 200, 300, or 400 is wound around a bobbin 51. In FIGS. 14 and 15, the bobbin rotates around a rotary shaft 95 to perform winding. A form where core winding is performed around a cylindrical core instead of the bobbin 51 may be adopted (not illustrated), or coreless winding may be performed without using the bobbin 51 (not illustrated). In addition, instead of roll winding in a state where the cross section is flat, the product-containing outer bag 100, 200, 300, or 400 may be wound by hank winding or may be zigzag-folded in a state where the cross section is flat (not illustrated). Here, the state where the cross section is flat refers to a state where the flat surfaces of the plurality of bags 3, 13, 23, or 33 accommodated in the product-containing outer bag 100, 200, 300, or 400 are in contact with the inner wall surface of the base material 5, 15, 25, or 35 having a cylindrical shape and a cross section where the cross-sectional shape of the plurality of bags 3, 13, 23, or 33 is reflected has an elongated shape. FIG. 15 illustrates a form where the cross section of the product-containing outer bag 100, 200, 300, or 400 is in a flat state, for example, has a substantially rectangular shape. When the product-containing outer bag 100 including the fastener 4 is roll-wound, the fastener 4 is in a state of being laid sideways, namely, in a state where the opening portion 6 is bent to lie in the base material 5. Since the cross section of the product-containing outer bag 100, 200, 300, or 400 is in a flat state, a space in the cylinder is deaerated and thus the product-containing outer bag 100, 200, 300, or 400 has a strip shape, and it is preferable that the product-containing outer bag 100, 200, 300, or 400 is wound such that outer wall surfaces thereof are in contact with each other. The volume of the product-containing outer bag 100, 200, 300, or 400 which is wound can be reduced. In addition, also in the form of zigzag folding, namely, in the form of folding in a zigzag manner, since the cross section of the product-containing outer bag 100, 200, 300, or 400 is in a flat state, the space in the cylinder is deaerated and thus the product-containing outer bag 100, 200, 300, or 400 has a strip shape, and it is preferable that the product-containing outer bag 100, 200, 300, or 400 is folded such that the outer wall surfaces thereof are in contact with each other. The volume of the product-containing outer bag 100, 200, 300, or 400 which is folded can be reduced.

(Production Method for Wound Product of Product-Containing Outer Bag)

Figure 16:
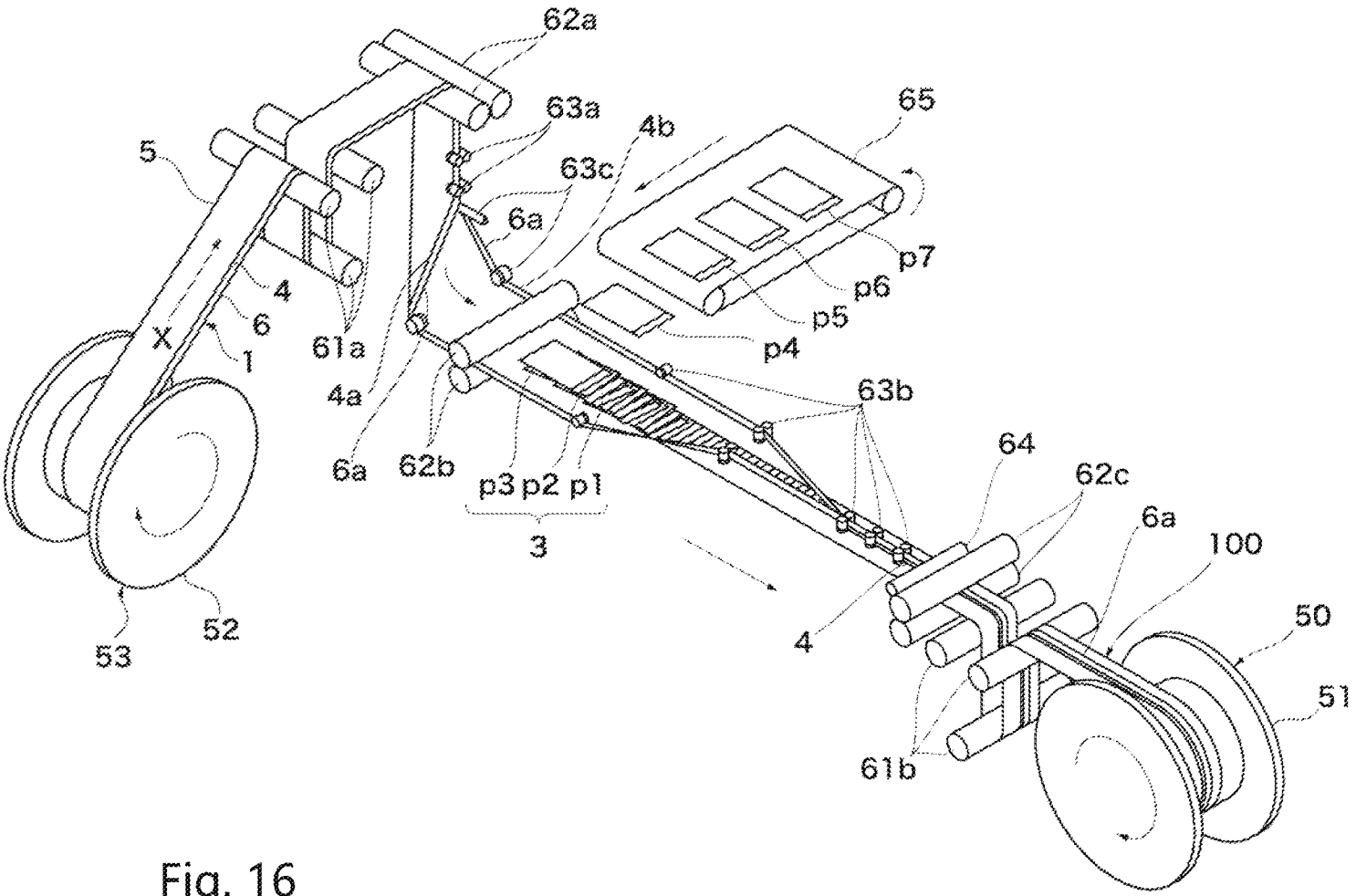
FIG. 16 is a schematic view for describing a first production method for a wound product of a product-containing outer bag according to the present embodiment, and is a view illustrating a form where a product-containing outer bag is the product-containing outer bag illustrated in FIG. 1.

Next, a production method for a wound product of a product-containing outer bag according to the present embodiment will be described with reference to FIG. 16. A production method for a product-containing outer bag according to the present embodiment is a production method for a product-containing outer bag in which the plurality of bags 3 that are stacked continuously or intermittently in a row for parts of the bags (p1, p2, p3, p4, . . . , pn), which are products, to overlap each other are wrapped with the cylindrical outer bag 1 with the fastener for outer packaging to be integrated while a stacked state of the bags 3 is held, wherein the cylindrical outer bag with the fastener is made of a resin film as the base material 5 and has a cylindrical shape having a uniform inner diameter and continuously extending along the cylinder length direction X, at least one opening portion 6 to be opened along the cylinder length direction X, and the fastener 4 on the inner wall side of the base material 5 along the edge 6*a* of the opening portion, the opening portion 6 has a structure where the opening portion 6 is closed when the fastener 4 is engaged, and the production method includes a first step of preparing the cylindrical outer bag 1 with the fastener; a second step of causing the fastener 4 to be disengaged and widening the cylindrical outer bag 1 with the fastener; a third step of stacking the bags continuously or intermittently in a row along a longitudinal direction Y of the base material 5 on the base material 5 for the parts of the bags (p1, p2, p3, p4, . . . , pn) to overlap each other; and a fourth step of folding the base material 5 to wrap the plurality of bags 3 with the base material 5 while moving the base material 5, on which the plurality of bags 3 are placed, in the longitudinal direction Y of the base material 5 and causing the fastener 4 to be engaged, to obtain the product-containing outer bag 100.

(First Production Method)

In the first production method, a cylindrical outer bag with a fastener for outer packaging and a product-containing outer bag are the cylindrical outer bag 1 with a fastener and the product-containing outer bag 100 illustrated in FIGS. 1 to 5, a bag is the bag p1 illustrated in FIGS. 6 and 7, and the product-containing outer bag 100 is wound around the same bobbin as the bobbin 51 illustrated in FIGS. 14 and 15. Furthermore, the longitudinal direction Y of the base material 5 is the same as the cylinder length direction X with reference to the base material 5.

(First Step)

A wound product 53 of an outer bag, namely, the cylindrical outer bag 1 with the fastener for outer packaging that is wound around a bobbin 52 is prepared. The cylindrical outer bag 1 with the fastener for outer packaging is wound around the bobbin 52 in a state where the fastener 4 is engaged and the cylinder is crushed to be flat such that the fastener 4 is located at the lateral end. The cylindrical outer bag 1 with the fastener for outer packaging is fed out in the direction of the cylinder length direction X to be delivered to a dance roll 61*a* and a pinch roll 62*a*. Incidentally, when the fastener 4 is separate from the base material 5, the first step includes step 1A of preparing a cylindrical film or half-cut film to which the fastener 4 is not bonded, and step 1B of attaching fastener tape to the cylindrical film or half-cut film.

(Second Step)

The fastener 4 is disengaged and the cylindrical outer bag 1 with the fastener is widened. Namely, the fastener 4 of the cylindrical outer bag 1 with the fastener for outer packaging which has passed through the pinch roll 62*a* is disengaged by a claw guide roll 63, and the cylindrical outer bag 1 with the fastener is widened and delivered to a pinch roll 62*b* in a state where the base material 5 is not overlapped.

(Third Step)

The base material 5 is widened into a flat sheet shape and the bags (p1, p2, p3, p4, . . . , pn) are placed on the base material 5. Specifically, the cylindrical outer bag 1 with the fastener is widened and the bags are stacked continuously or intermittently in a row along the longitudinal direction Y of the base material 5 on the base material 5, that is not overlapped, for the parts of the bags (p1, p2, p3, p4, . . . , pn) to overlap each other. FIG. 16 illustrates a form where the bags (p1, p2, p3, p4, . . . , pn) are stacked continuously in a row. Here, the bags (p1, p2, p3, p4, . . . , pn) are placed and delivered one by one on a transport conveyor 65 located downstream of the bag making machine (not illustrated). The bags, for example, the bags p4, p5, p6, and p7 on the transport conveyor 65 are to be sequentially placed on the base material 5.

(Fourth Step)

While the base material 5 on which the plurality of bags 3 are placed is moved in the longitudinal direction Y of the base material 5, the plurality of bags 3 are wrapped with the base material 5 by a claw guide roll 63*b* and the fastener 4 is engaged, so that the product-containing outer bag 100 is obtained. It is preferable that the product-containing outer bag 100 in which the fastener 4 is engaged is delivered to a touch roll 64, a pinch roll 62*c*, and a dance roll 61*b* in a state where the opening portion 6 is laid sideways in the vicinity of a base of the fastener 4. The inside of the product-containing outer bag 100 is deaerated, and thus the volume thereof is reduced.

(Fifth Step)

The product-containing outer bag 100 is wound around the bobbin 51 in a state where the cross section of the product-containing outer bag 100 is flat, so that the wound product 50 of the product-containing outer bag is obtained. FIG. 16 illustrates the form of roll winding; however, the product-containing outer bag 100 may be wound by hank winding or may be zigzag-folded in a state where the cross section of the product-containing outer bag 100 is flat.

According to the first production method, the cylindrical outer bag 1 with the fastener includes one fastener 4, in the second step, the base material 5 is horizontally widened, and in the fourth step, the fastener 4 is disposed and engaged above the stacking surface of the bags 3. According to the first production method, the bags 3 can be easily wrapped in the form of palm clapping with the outer bag 1 and the fastener 4 is easily engaged. For this reason, production is easily performed by an apparatus having a simple structure. In addition, the fastener 4 can be disengaged in the form of double doors.

(Second Production Method)

Figure 17:
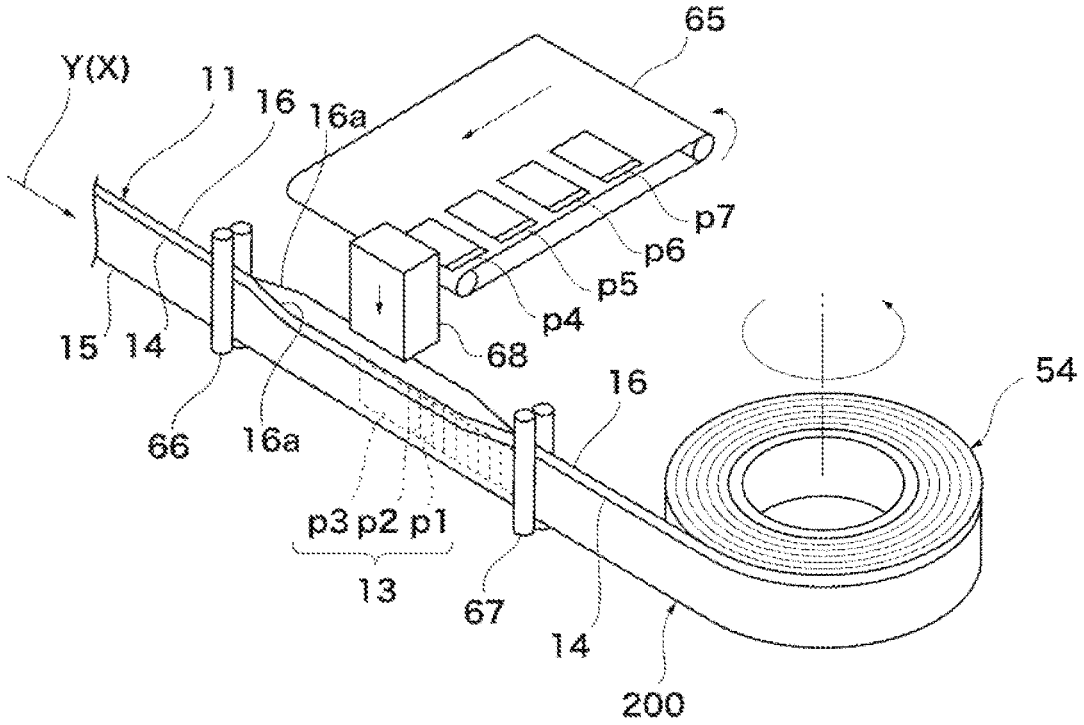
FIG. 17 is a schematic view for describing a second production method for a wound product of a product-containing outer bag according to the present embodiment, and is a view illustrating a form where a product-containing outer bag is the product-containing outer bag illustrating in FIG. 8.

Next, a second production method for a wound product of a product-containing outer bag according to the present embodiment will be described with reference to FIG. 17. Here, a cylindrical outer bag with a fastener for outer packaging and a product-containing outer bag are the cylindrical outer bag 11 with the fastener and the product-containing outer bag 200 illustrated in FIGS. 8 and 9, a bag is the bag p1 illustrated in FIGS. 6 and 7, and the product-containing outer bag 200 is wound around the same bobbin as the bobbin 51 illustrated in FIGS. 14 and 15 (the illustration of the bobbin is omitted in FIG. 17). Furthermore, the longitudinal direction Y of the base material 15 is the same as the cylinder length direction X with reference to the base material 15.

(First Step)

A first step is the same as that in the first production method. The illustration of the first step is omitted in FIG. 17. Incidentally, when the fastener 14 is separate from the base material 15, the first step includes step 1A of preparing a cylindrical film or half-cut film to which the fastener 14 is not bonded, and step 1B of attaching fastener tape to the cylindrical film or half-cut film.

(Second Step)

In the cylindrical outer bag 11 with the fastener for outer packaging which has passed through an opening claw 66, the base material 15 is widened, so that the cross section in the longitudinal direction Y of the base material 15 has a U shape or V shape and the fastener 14 is disengaged, so that the cylindrical outer bag 11 with the fastener is widened.

(Third Step)

It is preferable that the bags are put into the inside of the base material having the U shape or V shape in a state where either a right lateral end side or a left lateral end side of the bags faces downward. Since the bags can be neatly aligned by gravity, the bags are aligned in a more orderly manner in the product-containing outer bag. Namely, the cylindrical outer bag 11 with the fastener is widened and the bags are stacked continuously or intermittently in a row along the longitudinal direction Y of the base material 15 inside the base material 15 having the U shape or V shape for parts of the bags (p1, p2, p3, p4, . . . , pn) to overlap each other by a positioning device 68. FIG. 17 illustrates a form where the bags (p1, p2, p3, p4, . . . , pn) are stacked continuously in a row. Here, the bags (p1, p2, p3, p4, . . . , pn) are placed and delivered one by one on a transport conveyor 65 located downstream of the bag making machine (not illustrated). The bags, for example, the bags p4, p5, p6, and p7 on the transport conveyor 65 are to be sequentially put into the inside of the base material 15.

(Fourth Step)

While the base material 15, into which the plurality of bags 13 are put, is moved in the longitudinal direction Y of the base material 15, the plurality of bags 13 are wrapped with the base material 15 by a hooking claw 67 and the fastener 14 is engaged, so that the product-containing outer bag 200 is obtained. The inside of the product-containing outer bag 200 is deaerated, and thus the volume of the product-containing outer bag 200 in which the fastener 14 is engaged is reduced.

(Fifth Step)

The product-containing outer bag 200 is wound around the bobbin in a state where the cross section of the product-containing outer bag 200 is flat, so that a wound product 54 of the product-containing outer bag is obtained. FIG. 17 illustrates the form of roll winding; however, the product-containing outer bag 200 may be wound by hank winding or may be zigzag-folded in a state where the cross section of the product-containing outer bag 200 is flat.

(Third Production Method)

Figure 18:
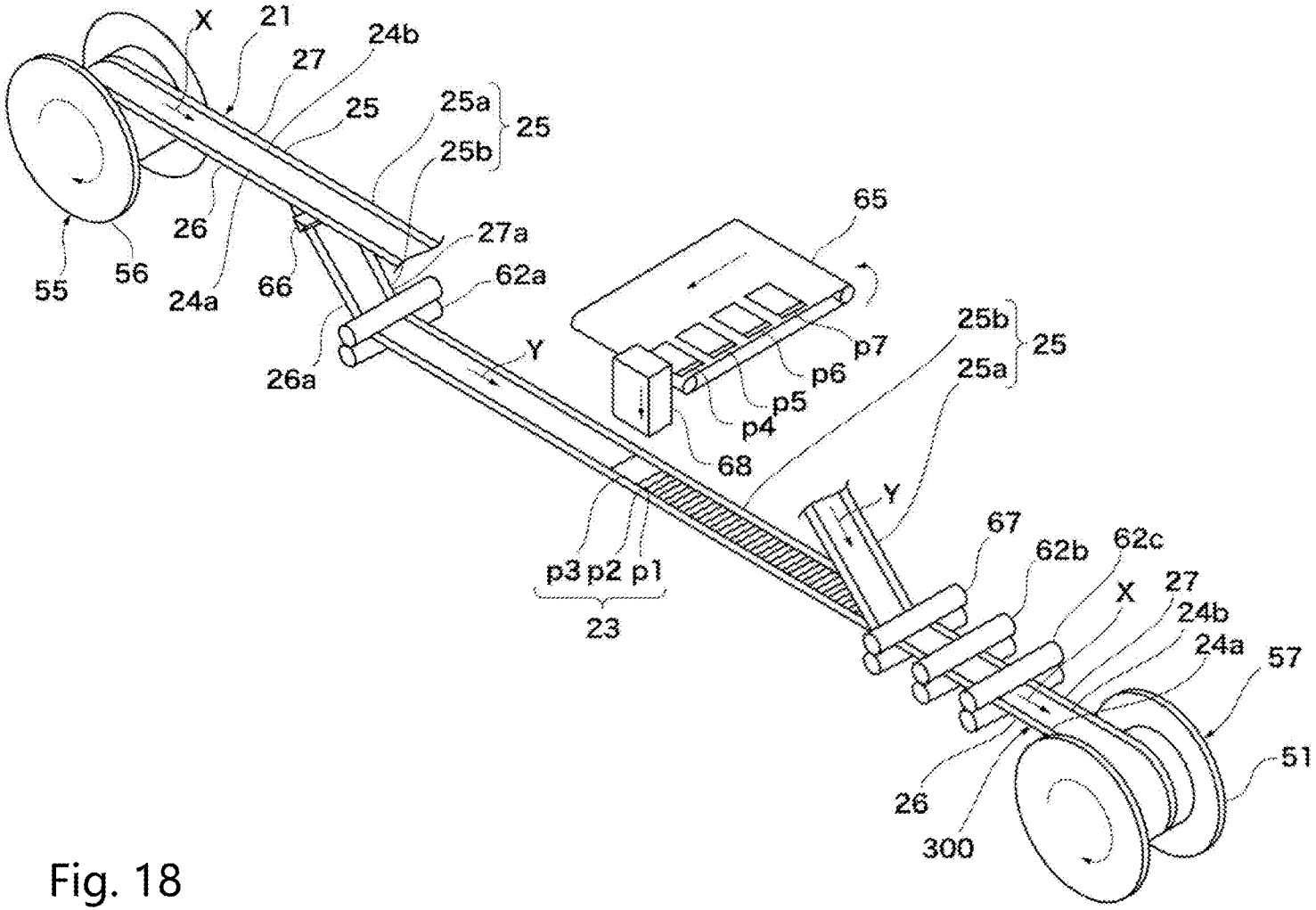
FIG. 18 is a schematic view for describing a third production method for a wound product of a product-containing outer bag according to the present embodiment, and is a view illustrating a form where a product-containing outer bag is the product-containing outer bag illustrating in FIG. 10.

Next, a third production method for a wound product of a product-containing outer bag according to the present embodiment will be described with reference to FIG. 18. Here, a cylindrical outer bag with a fastener for outer packaging and a product-containing outer bag are the cylindrical outer bag 21 with the fastener and the product-containing outer bag 300 illustrated in FIGS. 10 and 11, a bag is the bag p1 illustrated in FIGS. 6 and 7, and the product-containing outer bag 300 is wound around the same bobbin as the bobbin 51 illustrated in FIGS. 14 and 15. Furthermore, the longitudinal direction Y of the base material 25 is the same as the cylinder length direction X with reference to the base material 25.

(First Step)

A wound product 55 of an outer bag, namely, the cylindrical outer bag 21 with the fastener for outer packaging that is wound around a bobbin 56 is prepared. The cylindrical outer bag 21 with the fastener for outer packaging includes two fasteners and is wound around the bobbin 56 in a state where the fasteners 24*a* and 24*b* each are engaged and the cylinder is crushed to be flat such that the fasteners 24*a* and 24*b* are located at both lateral ends, respectively. The cylindrical outer bag 21 with the fastener for outer packaging is fed out in the direction of the cylinder length direction X to be delivered to the opening claw 66. Incidentally, when the fasteners 24*a* and 24*b* are separate from the base material 25, a first step includes step 1A of preparing a cylindrical film or half-cut film to which the fasteners 24*a* and 24*b* are not bonded, and step 1B of attaching fastener tape to the cylindrical film or half-cut film.

(Second Step)

In the cylindrical outer bag 21 with the fastener for outer packaging which has passed through the opening claw 66, the one part 25*b* of the base material 25 that is divided into two parts when the fasteners 24*a* and 24*b* are disengaged is horizontally widened and the other part 25*a* of the base material is horizontally widened above the one part 25*b* of the base material. The one part 25*b* of the base material is delivered to the pinch roll 62*a*. The other part 25*a* of the base material is also delivered to a pinch roll (not illustrated).

(Third Step)

It is preferable that the one part 25*b* of the base material is widened into a flat sheet shape and the bags are placed on the one part 25*b* of the base material in a state where the fasteners 24*a* and 24*b* located on both end sides in a width direction of the one part 25*b* of the base material are located on the left lateral end side and the right lateral end side of the bags (p1, p2, p3, p4, . . . , pn), respectively. Namely, the one part 25*b* of the base material is widened and the bags are stacked continuously or intermittently in a row along the longitudinal direction Y for parts of the bags (p1, p2, p3, p4, . . . , pn) to overlap each other by the positioning device 68. FIG. 18 illustrates a form where the bags (p1, p2, p3, p4, . . . , pn) are stacked continuously in a row. Here, the bags (p1, p2, p3, p4, . . . , pn) are placed and delivered one by one on a transport conveyor 65 located downstream of the bag making machine (not illustrated). The bags, for example, the bags p4, p5, p6, and p7 on the transport conveyor 65 are to be sequentially placed on the one part 25*b* of the base material.

(Fourth Step)

It is preferable that while the plurality of bags 23 are moved in the longitudinal direction Y in a state where the plurality of bags 23 are placed on the one part 25*b* of the base material, the bags 23 are covered with the other part 25*a* of the base material which has been simultaneously moved in the longitudinal direction Y and the fasteners 24*a* and 24*b* each are engaged by the hooking claw 67. The fasteners 24*a* and 24*b* each are engaged to obtain the product-containing outer bag 300. When the product-containing outer bag 300 in which the fasteners 24*a* and 24*b* each are engaged passes through the pinch rolls 62*b* and 62*c*, the inside of the product-containing outer bag 300 is deaerated, and thus the volume thereof is reduced. The bags 23 can be put into the cylindrical outer bag 21 by a simple operation where the cylindrical outer bag 21 with the fastener for outer packaging is divided into upper and lower parts, namely, the one part 25*b* of the base material and the other part 25*a* of the base material, the bags 23 are disposed therebetween, and the cylindrical outer bag 21 with the fastener for outer packaging is closed as before.

(Fifth Step)

The product-containing outer bag 300 is wound around the bobbin 51 in a state where the cross section of the product-containing outer bag 300 is flat, so that a wound product 57 of the product-containing outer bag is obtained. FIG. 18 illustrates the form of roll winding; however, the product-containing outer bag 300 may be wound by hank winding or may be zigzag-folded in a state where the cross section of the product-containing outer bag 300 is flat.

Figure 19:
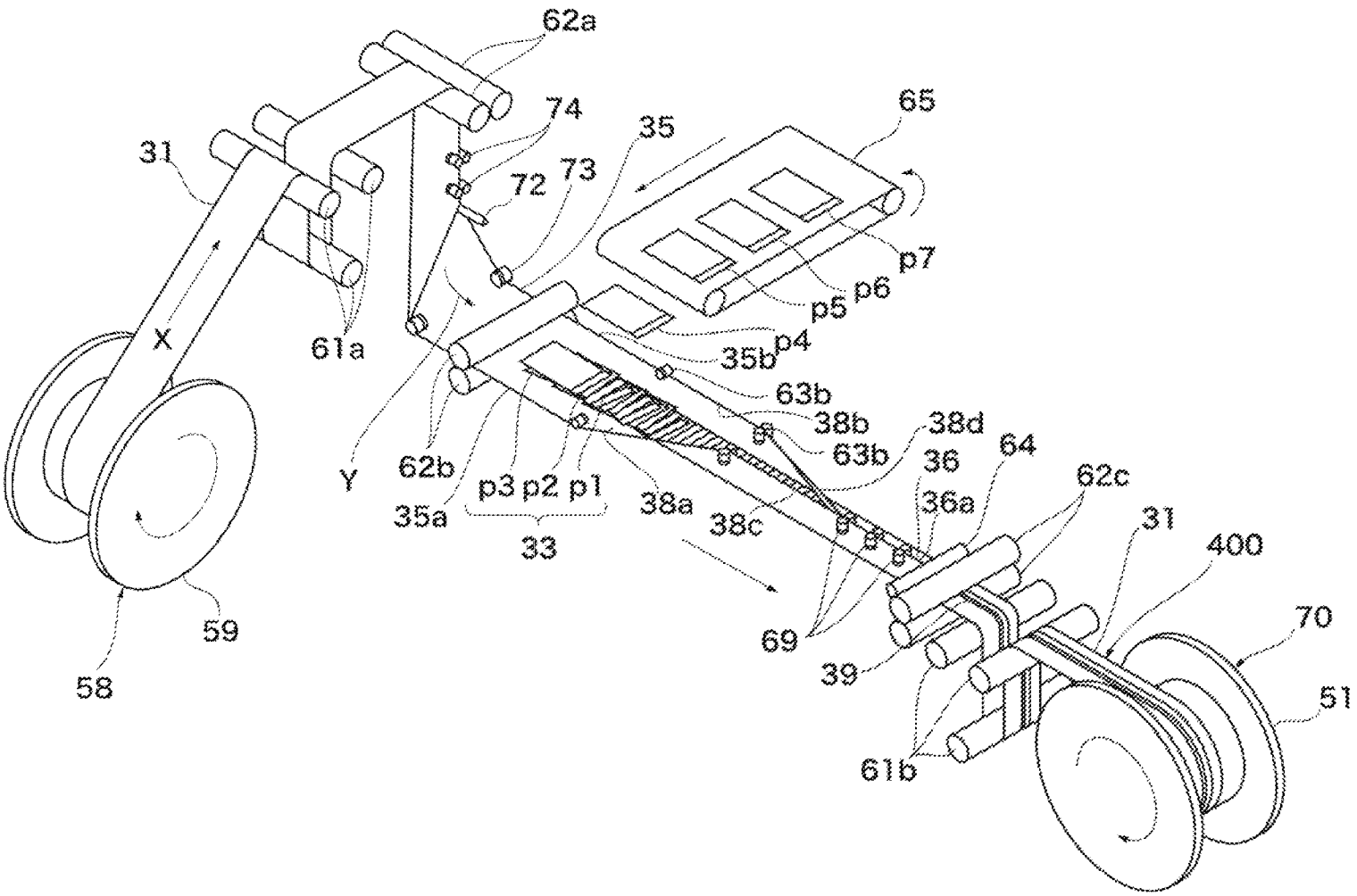
FIG. 19 is a schematic view for describing a fourth production method for a wound product of a product-containing outer bag according to the present embodiment, and is a view illustrating a form where a product-containing outer bag is the product-containing outer bag illustrating in FIG. 12.

Next, a production method for a wound product of a product-containing outer bag, which is a product-containing outer bag according to the present embodiment and in which a cylindrical outer bag that is a type of an outer bag not including a fastener is used, will be described with reference to FIG. 19. A production method for a product-containing outer bag according to the present embodiment is a production method for a product-containing outer bag in which the plurality of bags 33 that are stacked continuously or intermittently in a row for parts of the bags (p1, p2, p3, p4, . . . , pn), which are products, to overlap each other are wrapped with the cylindrical outer bag 31 for outer packaging to be integrated while a stacked state of the bags 33 is held, the method including: a step A of preparing a strip-shaped resin film with a uniform width as the base material 35; a step B of widening the base material 35; a step C of stacking the plurality of bags continuously or intermittently in a row along the longitudinal direction Y of the base material 35 on the base material 35 for the parts of the bags (p1, p2, p3, p4, . . . , pn) to overlap each other; and a step D of folding the base material 35 to wrap the plurality of bags 33 with the base material 35 while moving the base material 35, on which the plurality of bags 33 are placed, in the longitudinal direction Y of the base material 35, and mutually bonding or heat-welding the inner walls 38*a* and 38*b* or the inner wall 38*a* and the outer wall 38*d* of the base material 35 along both end edges 35*a* and 35*b* in a width direction of the base material 35 to form the base material 35 into a cylindrical shape, to obtain the product-containing outer bag 400.

(Fourth Production Method)

(Step A)

Subsequently, a fourth production method will be described in more detail with reference to FIG. 19. A strip-shaped resin film with a uniform width is prepared as the base material 35. In FIG. 19, one wound product 58 of the cylindrical outer bag 31, in which the cylindrical outer bag 31 that is a cylindrical resin film produced by inflation film molding and has a cylindrical shape having a uniform inner diameter and continuously extending along the cylinder length direction is wound around a bobbin 59, is prepared. In FIG. 19, the cylindrical outer bag 31 is fed out in the direction of the cylinder length direction X to be delivered to the dance roll 61*a* and the pinch roll 62*a*.

(Step B)

The base material 35 is to be widened. A cut is made at one location in a trunk portion along the cylinder length direction to obtain the strip-shaped resin film with a uniform width. Namely, after the cylindrical outer bag 31 that has passed through the pinch roll 62*a* passes through a guide roll 74, a cut is made at one location in the trunk portion along the cylinder length direction by a cutter 72 and the base material 35 is horizontally widened by a guide roll 73 to be delivered to the pinch roll 62*b* in a state where the base material 35 is not overlapped. Alternatively, in the step A, a wound product in which the strip-shaped resin film with a uniform width after cutting is wound around the bobbin is prepared and in the step B, the wound product may be delivered to the pinch roll 62*b* in a state where the wound product is horizontally widened without using the cutter.

(Step C)

The base material 35 is widened into a flat sheet shape and bags (p1, p2, p3, p4, . . . , pn) are placed on the base material 35. Specifically, a plurality of the bags are stacked continuously or intermittently in a row along the longitudinal direction Y of the base material 35 on the base material 35 that is widened, for parts of the bags (p1, p2, p3, p4, . . . , pn) to overlap each other. FIG. 19 illustrates a form where the bags (p1, p2, p3, p4, . . . , pn) are stacked continuously in a row. Here, the bags (p1, p2, p3, p4, . . . , pn) are placed and delivered one by one on a transport conveyor 65 located downstream of the bag making machine (not illustrated). The bags, for example, the bags p4, p5, p6, and p7 on the transport conveyor 65 are to be sequentially placed on the base material 35.

(Step D)

While the base material 35 on which the plurality of bags 33 are placed is moved in the longitudinal direction Y of the base material 35, the plurality of bags 33 are wrapped with the base material 35 by the claw guide roll 63*b* and the inner walls 38*a* and 38*b* of the base material 35 are mutually bonded or heat-welded along both the end edges 35*a* and 35*b* in the width direction of the base material 35 by a heat sealing machine 69 to form the joint portion 39 and form the base material 35 into a cylindrical shape, so that the product-containing outer bag 400 is obtained. Here, it is preferable that both the end edges in the width direction of the base material 35 are disposed above the stacking surface of the bags 33 and both the end edges in the width direction of the base material 35 are mutually bonded or heat-welded. The bags 33 can be easily wrapped in the form of palm clapping with the outer bag and bonding or heat welding is easily performed. For this reason, production is easily performed by an apparatus having a simple structure. In the product-containing outer bag 400, the plurality of bags 33 are wrapped with the cylindrical outer bag 31 for outer packaging. It is preferable that the product-containing outer bag 400 that is heat-sealed is delivered to the touch roll 64, the pinch roll 62*c*, and the dance roll 61*b*. At this time, the product-containing outer bag 400 is delivered in a state where the joint portion 39 is laid sideways. The inside of the product-containing outer bag 400 is deaerated, and thus the volume thereof is reduced. FIG. 19 illustrates a form where the inner walls 38*a* and 38*b* of the base material 35 are bonded or heat-welded; however, a form of bonding or heat-welding the inner wall 38*a* and the outer wall 38*d* or a form of bonding or heat-welding the inner wall 38*b* and an outer wall 38*c* may be adopted. FIG. 19 illustrates a form where heat sealing is performed by the heat sealing machine 69; however, bonding may be performed by gluing. In the step A, in either form of a form of using the wound product 58 of the cylindrical outer bag 31 and a form of using a wound product in which the strip-shaped resin film with a uniform width after cutting is wound around the bobbin, after the joint portion 39 is formed, the plurality of bags 33 can be in a state of being wrapped with the cylindrical outer bag 31 for outer packaging.

(Fifth Step)

The product-containing outer bag 400 is wound around the bobbin 51 in a state where the cross section of the product-containing outer bag 400 is flat, so that a wound product 70 of the product-containing outer bag is obtained. FIG. 19 illustrates the form of roll winding; however, the product-containing outer bag 400 may be wound by hank winding or may be zigzag-folded in a state where the cross section of the product-containing outer bag 400 is flat.

(Fifth Production Method)

Next, a fifth production method will be described. The fifth production method is the same as the second production method except that the base material is bonded or heat-welded to obtain a product-containing outer bag instead of a form where the fastener is engaged to obtain a product-containing outer bag. Namely, in the step A, one base material is prepared, in the step B, the base material is widened, so that the cross section in a longitudinal direction of the base material has a U shape or V shape, and in the step C, the bags are put into the inside of the base material having the U shape or V shape in a state where either a right lateral end side or and a left lateral end side of the bags faces downward. FIG. 19 illustrates a form where the base material 35 is widened horizontally and flat, as a form of widening the base material 35; however, a form where as illustrated in FIG. 17, the base material is widened such that the cross section has a U shape or V shape and the bags 33 are stacked therein in a state where the bags 33 are vertically placed such that lateral ends of the bags 33 are in contact with each other is adopted. In this form, the joint portion of the base material is located on a lateral end side of the bags 33.

(Sixth Production Method)

Next, a sixth production method will be described. The sixth production method is the same as the third production method except that the base material is bonded or heat-welded to obtain a product-containing outer bag instead of a form where the fastener is engaged to obtain a product-containing outer bag. Namely, in the step A, two base materials are prepared, in the step B, one base material is horizontally widened and the other base material is horizontally widened above the one base material, in the step C, the one base material is widened into a flat sheet shape and the bags are placed on the one base material in a state where both ends in a width direction of the one base material are located on a right lateral end side and a left lateral end side of bags, respectively, and in the step D, the bags are covered with the other base material and the one base material and the other base material are mutually joined. The bags can be put into the outer bag by a simple operation where the two base materials are disposed on upper and lower sides, the bags are disposed therebetween, and the outer bag is closed. In this form, the joint portions of the base material are located on both lateral end sides of the bags 33.

(Method for Supplying Bag)

A method for supplying a bag according to the present embodiment will be described with reference to FIG. 20. The method for supplying a bag according to the present embodiment includes a sixth step of opening an engaged portion or a location other than the engaged portion in an outer bag while pulling out the product-containing outer bag 100 according to the present embodiment or the outer bag of the wound product 50 of a product-containing outer bag according to the present embodiment, and a seventh step of sequentially supplying the bags 3 in the opened outer bag to the filling machine. The product-containing outer bag 200, 300, or 400 may be used as the product-containing outer bag. In addition, the wound product 54, 57, or 70 of the product-containing outer bag may be used as the wound product of a product-containing outer bag. When the product-containing outer bag 400 or the wound product 70 of the product-containing outer bag is used, while the outer bag is pulled out, the joint portion or a location other than the joint portion in the outer bag is opened. Furthermore, a zigzag-folded product of the product-containing outer bag may be used. When a location other the engaged portion in the outer bag, the joint portion, or a location other than the joint portion in the outer bag is opened, it is preferable that opening is performed by using a cutter. In addition, when a weak portion is provided at a location other than the engaged portion in the outer bag, the joint portion, or a location other than the joint portion in the outer bag, the outer bag may be opened from the weak portion.

(Sixth Step)

Figure 20:
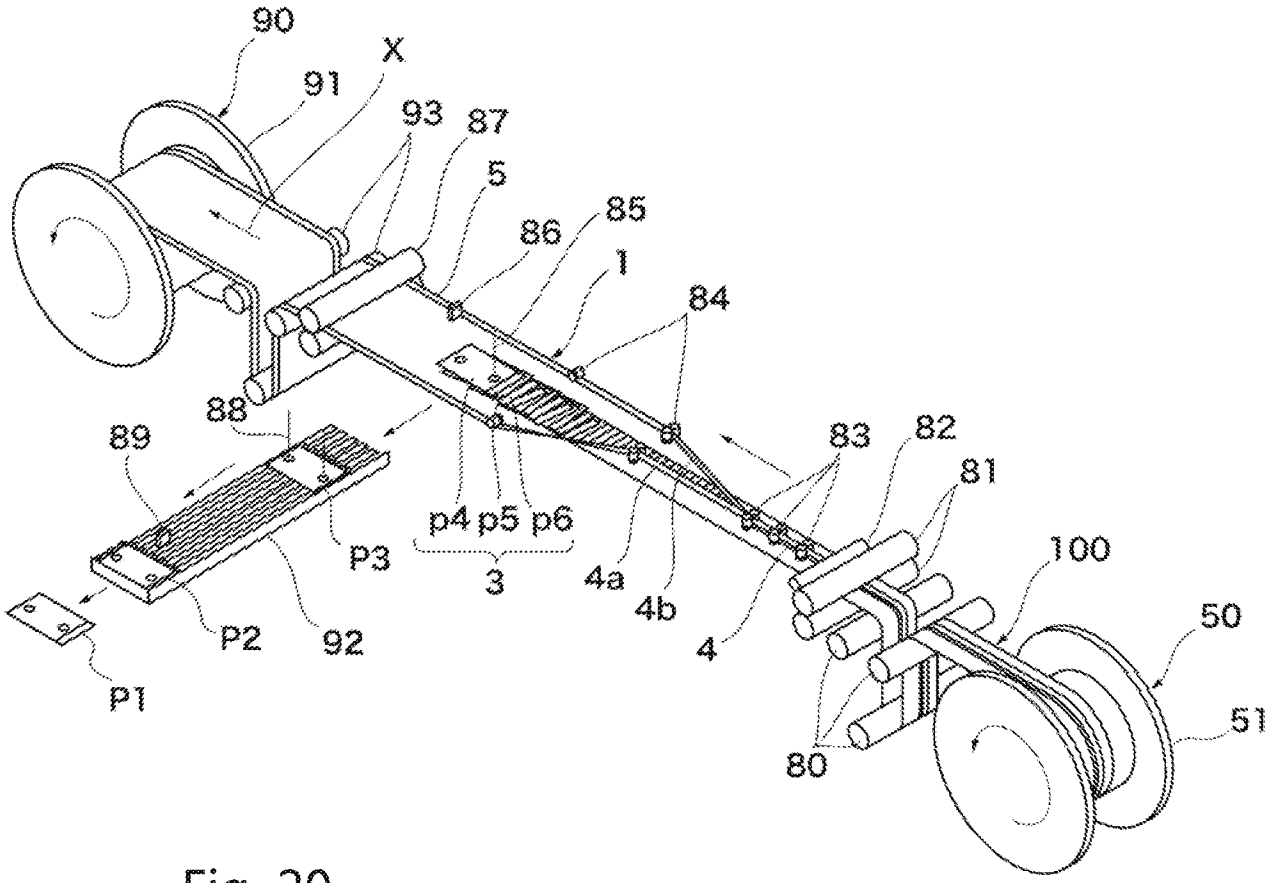
FIG. 20 is a schematic view for describing one form of a method for supplying a bag according to the present embodiment, and is a view illustrating a form where a wound product of a product-containing outer bag is the wound product of a product-containing outer bag obtained by the first production method.

As illustrated in FIG. 20, a step is performed in reverse order of the production method for the product-containing outer bag 100 or the outer bag of the wound product 50 of a product-containing outer bag. Namely, the wound product 50 of a product-containing outer bag is delivered to a dance roll 80, a pinch roll 81, and a touch roll 82 and subsequently, the fastener 4 that is laid sideways is raised by a guide roll 83. Subsequently, the female member **4*b* and the male member 4*a* each are guided by a claw guide roll 84, and the engaged portion of the fastener 4 or a location other than the engaged portion in the outer bag is opened. Incidentally, when the product-containing outer bag 400 or the wound product 70 of a product-containing outer bag is used, while the outer bag is pulled out, the joint portion or a location other than the joint portion in the outer bag is opened. In the sixth step, a packed state of the bags 3 can be reproduced as it is. Incidentally, the outer bag 1 is delivered to a pinch roll 87 and a touch roll 93 and is further wound around a bobbin 91, so that a wound product 90 of an outer bag 1 is obtained. The outer bag 1 after use, wound in the wound product 90 of the outer bag 1**, is discarded.

(Seventh Step)

The bags 3 in the outer bag 1 that is opened are sequentially supplied to the filling machine. Here, the bag p4 that is a leading one of the bags 3 placed on the base material 5 is detected by a bag detection tool 86 and is taken out to be placed on one end side of a positioning device 92 by a suctioning tool 85, to become the bag p3. The bag p3 placed on the one end side of the positioning device 92 is moved to the other end side of the positioning device 92 by a suctioning tool 88, to become the bag p2. A bag detection tool 89 detects whether or not a bag is present at the position of the bag p2. Then, the bag p2 is supplied to the filling machine (not illustrated) as the bag p1.

In the sixth step and the seventh step, the product-containing outer bag 100 or the wound product 50 of a product-containing outer bag can substantially reproduce the bag making machine, and the bags 3 can be supplied to the filling machine at high speed. Namely, it can be said that the inline of the bag making machine can be substantially reproduced in the filling machine. Then, it can be seen that the operation of binding bags is not required and an inspection step associated with the operation is also not required.

The present embodiment has a plurality of forms, and a part of each embodiment can be appropriately replaced or modified within the scope of the effects of the disclosure.

Figure 8:
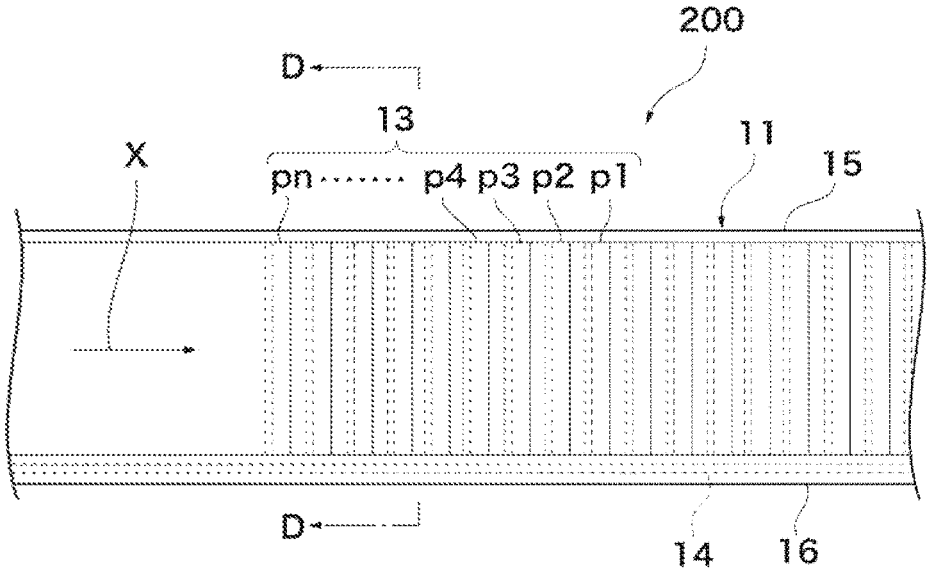
FIG. 8 is a front schematic view illustrating a second example of the product-containing outer bag according to the present embodiment.
Figure 9:
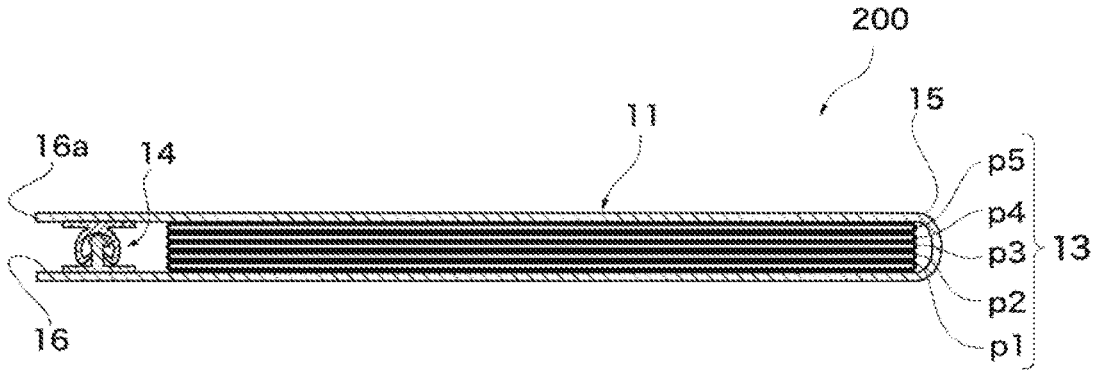
FIG. 9 is a cross-sectional view along line D-D in FIG. 8.

In the present embodiment, a form where a plurality of bags are wrapped with a cylindrical outer bag with a fastener to obtain a product-containing outer bag has been described; however, the product is not limited to the bag illustrated in FIGS. 8 and 9, and for example, the disclosure is also applicable to a card-shaped product. It is preferable that the products can be stacked in a row for parts thereof to overlap each other, and the product may be, for example, a paper product such as an advertisement, a pamphlet, or a booklet, a sheet-shaped desiccant, a toilet sheet for pets, or sheet-shaped food materials such as an edible sheet or seaweed. In addition, it is also feasible that products not having a card shape are arranged in a row at equal intervals and are wrapped with a cylindrical outer bag with a fastener or a cylindrical outer bag so as to hold the state.

REFERENCE SIGNS LIST

100, 200, 300, 400 PRODUCT-CONTAINING OUTER BAG

1, 11, 21 CYLINDRICAL OUTER BAG WITH A FASTENER
p1, p2, p3, p4, . . . , pn BAG
3, 13, 23, 33 PLURALITY OF BAGS (BAGS)
4, 14, 24*a*, 24*b* FASTENER
4*a*1 MALE BASE PORTION
4*a*2, 4*c* MALE PORTION
4*a* MALE MEMBER
4*b*1 FEMALE BASE PORTION
4*b*2, 4*d* FEMALE PORTION
4*b* FEMALE MEMBER
5, 15, 25, 35 BASE MATERIAL
25*b* ONE PART OF BASE MATERIAL
25*a* OTHER PART OF BASE MATERIAL
6, 16, 26, 27 OPENING PORTION OF OUTER BAG
6*a*, 16*a*, 26*a*, 27*a* EDGE OF OPENING PORTION OF OUTER BAG
7 ACCOMMODATING PORTION
8 OPENING PORTION OF BAG
9 CHUCK
20 REGION
31 CYLINDRICAL OUTER BAG (WITHOUT A FASTENER)
35*a*, 35*b* BOTH END EDGES IN WIDTH DIRECTION OF BASE MATERIAL
36 CUT PORTION
36*a* EDGE OF CUT PORTION
38*a*, 38*b* INNER WALL
38*c*, 38*d* OUTER WALL
39 JOINT PORTION
50, 54, 57 WOUND PRODUCT OF PRODUCT-CONTAINING OUTER BAG
58 WOUND PRODUCT OF CYLINDRICAL OUTER BAG
51, 56, 59, 91 BOBBIN
61*a*, 61*b*, 80 DANCE ROLL
62*a*, 62*b*, 62*c*, 81, 87 PINCH ROLL
63, 63*b*, 84 CLAW GUIDE ROLL
64, 82, 93 TOUCH ROLL
65 TRANSPORT CONVEYOR
66 OPENING CLAW
67 HOOKING CLAW
68 POSITIONING DEVICE
69 HEAT SEALING MACHINE
72 CUTTER
73, 74, 84 GUIDE ROLL
85 SUCTIONING TOOL
86 BAG DETECTION TOOL
89 BAG DETECTION TOOL
90 WOUND PRODUCT OF OUTER BAG
92 POSITIONING DEVICE
95 ROTARY SHAFT OF BOBBIN
X CYLINDER LENGTH DIRECTION
Y LONGITUDINAL DIRECTION OF BASE MATERIAL

What is claimed is:

1. A product-containing outer bag (100, 200, 300) comprising a plurality of bags (3, 13, 23) which are wrapped with a cylindrical outer bag (1, 11, 21) with a fastener (4, 14, 24*a*, 24*b*);

wherein the plurality of bags (3, 13, 23) are stacked in a row so that parts of the plurality of bags (3, 13, 23), which are products, overlap each other, and the plurality of bags (3, 13, 23) are arranged to be continuously connected along the cylinder length direction (X) or are arranged to be interrupted at locations on the way along the cylinder length direction (X);

wherein the plurality of bags (3, 13, 23) are integrated in the cylindrical outer bag (1, 11, 21) with the fastener (4, 14, 24*a*, 24*b*) while a stacked state of the plurality of bags (3, 13, 23) is held;

wherein the cylindrical outer bag (1, 11, 21) with the fastener (4, 14, 24*a*, 24*b*) is used for outer packaging;

wherein the cylindrical outer bag (1, 11, 21) with the fastener (4, 14, 24*a*, 24*b*) is made of a resin film as a base material (5, 15, 25) and has a cylindrical shape having a uniform inner diameter and continuously extending along a cylinder length direction (X);

wherein the cylindrical outer bag (1, 11, 21) with the fastener (4, 14, 24*a*, 24*b*) has at least one opening portion (6, 16, 26, 27) to be opened along the cylinder length direction (X);

wherein the fastener (4, 14, 24*a*, 24*b*) is provided on an inner wall side of the base material (5, 15, 25) along an edge (6*a*, 16*a*, 26*a*, 27*a*) of the at least one opening portion (6, 16, 26, 27); and wherein the fastener (4, 14, 24*a*, 24*b*) is engaged.

2. The product-containing outer bag (100, 200, 300) according to claim 1, wherein the plurality of bags (3, 13, 23) that are stacked continuously or intermittently in a row so that parts of the plurality of bags (3, 13, 23), which are products, overlap each other, are placed on the base material (5, 15, 25);

wherein the base material (5, 15, 25) is formed of a flat sheet-shaped resin film with the fastener (4, 14, 24*a*, 24*b*) for outer packaging; and wherein the base material (5, 15, 25) is folded to wrap the plurality of bags (3, 13, 23) with the base material (5, 15, 25), so that the cylindrical outer bag (1, 11, 21) with the fastener (4, 14, 24*a*, 24*b*) is obtained, and the plurality of bags (3, 13, 23) are integrated in the cylindrical outer bag (1, 11, 21) with the fastener (4, 14, 24*a*, 24*b*), while the stacked state of the plurality of bags (3, 13, 23) is held.

3. The product-containing outer bag (100, 200, 300) according to claim 1, wherein the cylindrical outer bag (1, 11, 21) includes one fastener (4); and wherein the fastener (4) is located and engaged above a stacking surface of the plurality of bags (3).

4. The product-containing outer bag (100, 200, 300) according to claim 1, wherein the cylindrical outer bag (1, 11, 21) includes one fastener (14); and wherein the fastener (14) is located and engaged on either a right lateral end side or a left lateral end side of the plurality of bags (13).

5. The product-containing outer bag (100, 200, 300) according to claim 1, wherein the cylindrical outer bag (1, 11, 21) includes two fasteners (24*a*, 24*b*); and wherein the fasteners (24*a*, 24*b*) are located and engaged on a right lateral end side and a left lateral end side of the plurality of bags (23), respectively.

6. A wound product (50, 54, 57) or a zigzag-folded product of a product-containing outer bag (100, 200, 300) according to claim 1, wherein the product-containing outer bag (100, 200, 300) is a wound product, a hank-winding product, or a zigzag winding product in a state where a cross section of the product-containing outer bag (100, 200, 300) is flat.

* * * * *